US008960440B1

(12) United States Patent
Kronberg

(10) Patent No.: US 8,960,440 B1
(45) Date of Patent: Feb. 24, 2015

(54) BLISTER PACK CONTENT USAGE MONITORING

(71) Applicant: Verimed Holdings, LLC, Charlotte, NC (US)

(72) Inventor: James W. Kronberg, Aiken, SC (US)

(73) Assignee: Verimed Holdings, LLC, Charlotte, NC (US)

( * ) Notice: Subject to any disclaimer, the term of this patent is extended or adjusted under 35 U.S.C. 154(b) by 0 days.

(21) Appl. No.: 14/141,599

(22) Filed: Dec. 27, 2013

(51) Int. Cl.

| | |
|---|---|
| ***B65D 83/04*** | (2006.01) |
| ***B65D 85/42*** | (2006.01) |
| ***G08B 21/00*** | (2006.01) |
| ***A61J 7/04*** | (2006.01) |
| ***A61J 1/03*** | (2006.01) |

(52) U.S. Cl.
CPC ... *A61J 7/04* (2013.01); *A61J 1/035* (2013.01)
USPC ..... 206/531; 206/534; 340/540; 340/539.12; 340/568.1

(58) Field of Classification Search
CPC ..... A61J 1/035; A61J 7/0481; G06F 19/3462; G06F 19/3418; B65D 2203/10; B65D 2585/56
USPC ..... 340/540, 539.12, 568.1, 568.2, 571, 340/635, 636.15, 652; 206/531, 534, 528, 206/538
See application file for complete search history.

(56) References Cited

U.S. PATENT DOCUMENTS

| | | | |
|---|---|---|---|
| 4,526,474 | A | 7/1985 | Simon |
| 4,617,557 | A | 10/1986 | Gordon |
| 5,072,430 | A | 12/1991 | Eckernäs et al. |
| 5,181,189 | A | 1/1993 | Hafner |
| 5,412,372 | A | 5/1995 | Parkhurst et al. |
| 5,871,831 | A | 2/1999 | Zeiter et al. |
| 6,244,462 | B1 | 6/2001 | Ehrensvard et al. |
| 6,411,567 | B1 | 6/2002 | Niemiec et al. |
| 6,574,166 | B2 | 6/2003 | Niemiec |
| 6,839,304 | B2 | 1/2005 | Niemiec et al. |
| 6,961,285 | B2 | 11/2005 | Niemiec et al. |
| 6,973,371 | B1 | 12/2005 | Benouali |
| 7,113,101 | B2 | 9/2006 | Petersen et al. |
| 7,126,879 | B2 | 10/2006 | Snyder |
| 7,178,417 | B2 | 2/2007 | Petersen et al. |
| 7,252,208 | B1 | 8/2007 | Alvino et al. |
| 7,304,913 | B2 | 12/2007 | Niemiec et al. |
| 7,451,876 | B2 | 11/2008 | Bossi et al. |

(Continued)

FOREIGN PATENT DOCUMENTS

WO WO 2010108838 A1 * 9/2010

*Primary Examiner* — Eric M Blount
(74) *Attorney, Agent, or Firm* — Michael A. Mann; Nexsen Pruet, LLC

(57) ABSTRACT

A system is provided for monitoring the removal of blister pack contents. An array of spatially-extended, electrically parallel breakable traces made from electrically resistive material is formed behind a corresponding array of blisters of a blister card. Then this array is connected in series with a reference resistor to form a voltage divider. All resistive traces are formed from the same materials in a single operation. Blister breakage is determined using changes in the ratio of the resistances of the array and the divider. A predictive algorithm is used to adjust the threshold resistance ratio change that signals blister breakage and voltage ratios are used to adjust for battery output changes over time. Breakage events and their time of occurrence are recorded in nonvolatile memory for later retrieval. Additional resistors can be used for activating the system and detecting tampering.

34 Claims, 9 Drawing Sheets

(56) References Cited

U.S. PATENT DOCUMENTS

| | | | | |
|---|---|---|---|---|
| 7,489,594 | B2 | 2/2009 | Simon et al. | |
| 7,502,666 | B2 | 3/2009 | Siegel et al. | |
| 7,552,824 | B2 | 6/2009 | Le et al. | |
| 7,612,662 | B2 | 11/2009 | Niemiec et al. | |
| 7,710,269 | B2 | 5/2010 | Reep | |
| 7,720,568 | B2 | 5/2010 | Berg et al. | |
| 7,751,933 | B2 | 7/2010 | Handfield et al. | |
| 7,828,147 | B2 | 11/2010 | Caracciolo et al. | |
| 7,878,367 | B2 | 2/2011 | Simon et al. | |
| 7,937,829 | B2 | 5/2011 | Petersen et al. | |
| 8,014,232 | B2 | 9/2011 | Niemiec et al. | |
| 8,025,149 | B2 | 9/2011 | Sterry et al. | |
| 8,151,990 | B2 | 4/2012 | Udo et al. | |
| 2008/0053040 | A1 | 3/2008 | Petersen et al. | |
| 2009/0184023 | A1* | 7/2009 | Brollier et al. | 206/531 |
| 2010/0089789 | A1* | 4/2010 | Rosenbaum et al. | 206/531 |
| 2010/0089791 | A1* | 4/2010 | Rosenbaum et al. | 206/531 |
| 2012/0145573 | A1* | 6/2012 | Scharfeld et al. | 206/223 |
| 2013/0325501 | A1* | 12/2013 | Walker et al. | 705/2 |
| 2014/0039445 | A1* | 2/2014 | Austin et al. | 604/404 |

* cited by examiner 150c
150b
150a
134
120a
144
142a
160
152
154
166
130
162
164
170
168

BLISTER PACK CONTENT USAGE MONITORING

PRIORITY CLAIM

None.

BACKGROUND OF THE INVENTION

The invention relates to a packaging device and electronic use-monitoring system for items intended to be dispensed over a period of time or on a particular schedule, such as prescription medications.

Medications, including prescription and over-the-counter pharmaceuticals, as well as vitamins and other dietary supplements, form a mainstay of health care, maintenance, and disease management and prevention. Typically a medication is given in repeated oral doses, usually as pills (here taken to include capsules), spread out over time so as to sustain desired levels of active ingredients in the patient's body. Any substantial deviation from the recommended timing, such as missing a dose or "doubling up" on doses, may decrease a medication's effectiveness or cause outright harm to the patient.

Pills have historically been provided to patients in bottles, each bottle containing only one type of pill, with the dosing recommendations written or printed on the label but with no means to ensure the patient has, in fact, followed those recommendations. For a healthy, alert and non-addicted patient taking one or just a few types of medication, that protocol is usually satisfactory. With patients, however, who are elderly, distracted by pain, or mentally dulled—sometimes by the very drugs they are taking—and especially for those who are simultaneously on several different medications, the frequency of errors can increase dramatically. A patient directed to take two pills from a first bottle and one from a second, for example, might mistakenly take one from the first and two from the second instead. Patients are unlikely to report such errors to their physicians.

As lifespans increase and the average patient age rises, and as individual patients are prescribed increasing numbers of different medications, errors can be expected to pose an ever-worsening problem.

To minimize these errors, a growing trend for pharmacies is to package medications not "by kind" in prescription bottles, but "by dose": placing medications to be taken at the same time together, but separated from those to be taken at other times. Typically, each pill or group of pills is held in a molded plastic blister attached to a card, with separate blisters holding doses to be taken at different times. For example, a patient might receive a card with twenty-eight separate plastic blisters, half ringed in red and half in blue, representing a two-week supply of several prescriptions combined. Red-ringed blisters would then be opened and the medications in them taken in the morning, blue-ringed ones in the evening before retiring.

Blister packaging for prescription drugs has been common in Europe for a decade or more, and is slowly penetrating the U.S. market as well. Many pharmacies will provide blister packaging of prescriptions "by dose" on request, for a small extra fee. Blister packaging is also widely used for over-the-counter (OTC) medications, especially where exceeding recommended doses could be hazardous.

Advantages of blister packaging include better protection of product integrity and quality, better tamper evidencing and child resistance, and improved patient compliance since "by dose" packaging helps eliminate confusion.

A further complication results from the fact that many medications now prescribed for patients are also targets for abuse, and of those, many are addictive. Pain medications such as opiates and oxycodone are obvious examples. A patient dissatisfied with the relief from a single pill might decide to take two or more at once and, after a time, find even that dose ineffective. Such use of ever-greater doses could lead to addiction. Conversely, on no longer needing the pills the patient might decide to sell them instead, or pass them along to a friend. Or, medications might be diverted by a third party for sale.

To ensure that medications are being taken on the prescribed schedule—and thus, presumably, also by the intended patient—a blister pack can be fitted with electronic means for detecting the opening of each blister and recording the time at which it was opened. Other high-value, potentially hazardous or diversion-prone items could be packaged and monitored similarly. Blasting caps, for example, might be blister-packed and electronically monitored to create a record of when each had been removed from the package. Monitoring in this case would create a record of removal for use and prevent, or at least detect, any unauthorized use or diversion.

While many detection schemes have been proposed, the only ones which appear cost-effective, and those most often seen in the prior art, have relied on the breakage of conductive traces in a printed-circuit-like array formed on a card or other substrate which supports the blisters, and through which an opening must be made to access the contents of each. These schemes in turn fall into two main groups: digital approaches where each trace uniquely identifies one of the blisters and by its breakage signals that that blister has been opened, and analog ones where a resistance is altered in stages as successive blisters are opened.

FIG. 1 illustrates a typical prior-art digital electronically monitored card, while FIG. 2 shows the corresponding circuit as a schematic diagram. While in an actual embodiment the blisters might number several dozen, for clarity in these Figures only three blisters and their associated circuitry are shown.

A sheet 10, typically made of stiff clear plastic, is impressed with blisters 12*a*, 12*b*, 12*c* and so forth. Closing the backs of these blisters is a sheet 14 of paper, foil, plastic, light cardboard or other air- and moisture-tight but easily broken material having a nonconductive surface 16 serving as the substrate on which a plurality of electrically conductive traces 20*a*, 20*b* and so forth, much like those on a printed circuit board and all having roughly equal conductivity, are formed by any of several methods well-known in the art of creating conductive circuit paths, including but not limited to screen, pad, flexographic and ink-jet printing with conductive inks, mechanical engraving, die-cutting or etching of foil, and chemical or vapor deposition. While surface 16 bearing these traces is shown in FIG. 1 as located on the side of sheet 14 opposite blisters 12*a*, 12*b*, 12*c* and so forth, it could equally well be located on the side of sheet 14 facing the blisters, or nonconductive trace-bearing surfaces could be located on both sides of the sheet.

Traces 20*a*, 20*b* and so forth connect with an electronics module 30 containing a monitoring system usually including batteries, a simple microcontroller, nonvolatile memory such as EEPROM or flash memory, and means such as a USB port for connection to an external computer. One, and only one, trace crosses the sheet behind each blister and typically there forms a zig-zag, labyrinthine or otherwise spatially extended pattern 32*a*, 32*b*, 32*c* and so forth, covering substantially the entire back of the corresponding blister 12*a*, 12*b*, 12*c* or the like and thus ensuring that the trace will be broken no matter how sheet 14 is cut or torn to open the blister. For purposes of illustration, traces 32*a* and 32*b* are shown as intact in FIG. 2 while trace 32*c* is shown as broken.

At least one other trace, exemplified in FIGS. 1 and 2 by trace 20*a*, does not form such an extended pattern and is not expected to be broken when blisters are opened. Instead, this trace forms a common bus 34 connected to a plurality of the pattern-forming traces. The dashed line extending to the right from bus 34 in FIG. 2 indicates that additional pattern-forming traces beyond the three shown in the Figure will typically be present. Module 30 holds trace 20*a* and bus 34, at least intermittently, at a first voltage which represents a first logic value to the electronics within the module.

The end 36*a*, 36*b*, 36*c* or the like of each pattern-forming trace opposite to bus 34 is connected to a separate input such as 42*a*, 42*b* or 42*c* of electronics module 30. Each input is so constructed that in the absence of any input, it is weakly pulled toward a second voltage representing the opposite logic state. As a result, when a pattern-forming trace is intact, its connected input reads the logic state corresponding to bus 34's voltage, while if the trace is broken the input receives no external signal and reads the opposite logic state instead.

For example, classical TTL and later logic families designed to be compatible with it read any input voltage above +2.0 volts as logic "1." Voltages between ground and +0.8 volts are read as logic "0," while those between +0.8 and +2.0 volts are indeterminate and are normally avoided. To avoid indeterminate voltages on disconnected inputs, TTL-type gates are designed with internal "pull-up" so an input receiving no signal will also be read as logic "1."

Monitoring system 30 periodically samples the inputs, and counts the number of inputs whose voltages correspond to broken traces. The resulting count, at least in theory, equals the number of blisters opened. If its number differs from the last recorded value, the system records the new number in nonvolatile memory along with the time at which it first appeared. To conserve power, system 30 may then enter a low-power "sleep" mode for some preselected interval of time. At the end of this period, the cycle is repeated. Sampling, and recording data as needed, continues until all blisters have been opened.

The result is a record in memory of all of the times when blisters were opened, along with the number of blisters opened each time. Since the memory is nonvolatile, this record will persist until it is read back out by a suitably programmed computer connected to system 30. The resulting data can be compared easily with the prescribed dosing cycle, for example of a prescribed medication, and patient compliance thus determined.

A disadvantage of this approach is the need for a large number of separate inputs to electronics module 30, one input for each individual blister to be monitored. A greater number of input lines requires either a larger microcontroller, or means separate from the microcontroller for multiplexing many digital signals onto a smaller number of lines. Either of these approaches is likely to increase the system cost.

Another disadvantage is the requirement for a least as many traces as there are blisters, since given any particular trace-forming technology some minimum amount of conductive material will be needed to form each of them and such material is inherently costly. In screen printing, for example, traces are typically formed by the deposition of an ink heavily loaded with powdered silver.

Yet another disadvantage is that the typically close placement of blisters on a card leaves little, if any, space on surface 16 remaining safe from damage when they are opened. A blister located near module 30 would probably have traces corresponding to a plurality of more distant blisters running closely adjacent to it. In opening that blister a careless, distracted or mentally dulled patient might well damage adjacent traces, falsely signaling that other blisters had also been opened when in fact they remained intact. This possibility gravely impacts the reliability of any such digital system.

FIG. 3 represents a typical prior art analog electronically monitored card, while FIG. 4 shows the corresponding circuit as a schematic diagram. Except as described below, all parts are the same as in the digital version shown in FIGS. 1 and 2.

The analog version differs in that a separate conductive trace need not run from each spatially extended trace pattern to a separate input on electronics module 30. Instead, a plurality of such trace patterns 32*a*, 32*b*, 32*c*, and so forth are connected in series, sharing a common connection a single module 30 input such as 42*a* through traces 20*a* and 20*b* or the like.

Just as in the digital version, trace patterns 32*a*, 32*b* and so forth are placed behind the blisters formed in sheet 10 so as to be broken when corresponding blisters are opened. A card may hold either just one series network of such trace patterns, connecting those corresponding to all blisters on the card, or a plurality of such networks, each for instance connecting the traces corresponding to blisters in just one row or column.

Obviously, with no further elaboration, such a network could detect only the first trace breakage in the series. An additional "bridging" trace such as 50*a*, 50*b* or 50*c*, having a significantly higher resistance per unit length than other traces on the card, is therefore placed in parallel with each yet in such a location as to remain safe from damage when blisters are opened. As a result, when each pattern-forming trace is broken, its corresponding resistive trace remains, forming an electric "bridge" across the gap. The network's total resistance will thus increase by steps as successive blisters are opened, each step equal to the resistance of one bridge.

Bridging traces 50*a*, 50*b*, 50*c*, and the like, are typically made from a different conductive material from that in the other traces on the card, and having an inherently much higher resistance per unit length. For example, in a screen-printing process where the low-resistance traces are formed by silver-bearing ink, the resistive traces might be formed by an ink bearing carbon instead.

Such traces, and the materials used to form them, will hereafter be referred to as "conductive" and "resistive" respectively, regardless of the fact that they differ only in the relative amounts of resistance present. The word "ink" will be used in a general sense to mean any trace-forming material, whether applied through screen printing or by any other process, with the understanding that screen printing is a conceptually simple process generally representative of all others.

The total resistance $R_T$ of such a series network can be read by any of several methods well-known in the art of electrical measurement. For example, a known source voltage $V_s$ can be applied between an output 44 and an input such as 42*a* on module 30. By Ohm's Law, the measured current $I_m$ flowing in the network will equal the source voltage divided by the network resistance, and if all bridges have equal resistance $R_b$, $I_m$ will equal $V_s/n\ R_b$ where n is the number of blisters opened. Alternatively, a known source current $I_s$ can be sent through the network and the resulting voltage $V_m$, equal to $nI_sR_b$, can be measured. This latter method is used in virtually all modern digital ohmmeters. Measurement functions are performed by circuitry, typically including an analog-to-digital converter (ADC) plus an auxiliary current-sensing resistor or fixed-current source, wholly housed within module 30.

This method of blister opening detection avoids the major disadvantages of the digital one since, as can be seen from FIG. 2, it dramatically reduces the numbers of required traces and needed microcontroller inputs: from one per blister plus one or more supply traces, down to one for a whole group of blisters—typically one or even a plurality of rows or columns—plus, again, one or more supply traces. This can bring cost savings both in microcontroller capacity and in conductive trace material. The drastic reduction in trace number also permits the remaining traces to be wider and hence more rugged, making accidental breakage less likely.

The analog method, unfortunately, brings problems of its own, caused by the difficulty in making traces with resistance values both closely reproducible and high enough to be useful.

Again taking screen printing as an example, resistive inks depend on contact (or at least near-contact, permitting electron tunneling) between adjacent carbon particles embedded in a binder material. Heavily-loaded inks have much interparticle contact and thus low resistivities, but those resistivities are closely reproducible: much as the number of cars comprising a railroad train passing a given point is closely reproducible, since all are evenly spaced. A more lightly-loaded ink has less contact and thus higher resistivity, but that resistivity is less reproducible due to variable spacing between particles within the binder material: much as the number of automobiles passing a given point on a highway may vary widely due to the wider, and more widely variable, distances between them than between railroad cars.

For the bridges in an analog network to have consistent values, therefore, an ink with low intrinsic resistivity (high carbon loading) must be chosen. Such an ink is usually given a sheet resistance rating in "ohms per square" by the manufacturer, meaning that if the shape of a trace having the nominal applied thickness is approximated by a series of squares, its total resistance after processing will be roughly the number of squares multiplied by the sheet resistance. Typical sheet resistance values lie in the range from 10 to 100 Ω/square at a nominal 0.025-millimeter (1-mil) thickness.

Consider, for example, the four resistive traces shown in Table 1 and representative of those which might be used in a blister-package application. Trace 1 here serves as a benchmark, with Traces 2, 3 and 4 each varying from it in only one of the three variables of trace length, trace width and ink resistance, as indicated in each case by an asterisk. For comparison, Trace 5 varies in both length and width but in such a way as to have the same number of squares and thus the same total resistance as Trace 1. All variables for each trace are assumed to be constant at the nominal values shown.

TABLE 1

| Trace | Length, millimeters | Width, millimeters | Squares | Ink sheet resistance, Ω/sq | Total trace resistance, ohms |
|---|---|---|---|---|---|
| 1 | 100 | 0.5 | 200 | 50 | 10,000 |
| 2 | 200* | 0.5 | 400 | 50 | 20,000 |
| 3 | 100 | 1.0* | 100 | 50 | 5000 |
| 4 | 100 | 1.0 | 200 | 10* | 2000 |
| 5 | 200* | 1.0* | 200 | 50 | 10,000 |

As is readily seen, increasing the trace's length or the ink's sheet resistance will increase the resistance, as will decreasing the width of the trace. In general, the trace resistance $R_t$ is closely approximated by the equation $R_t=LR_s/W$, where L is the trace's length, W its width, and $R_s$ the sheet resistance of the ink after processing. Minor corrections must be made if the trace makes bends or angles. For example, the square at the corner of a sharp 90-degree bend contributes only about one-half of the usual resistance since most of the current passing through it travels a path shorter than its full width. Such corrections are well-known in the art of thick-film, thin-film and semiconductor resistor design.

Any damage to the trace, even if it does not completely interrupt it, will change its resistance, since, in the vicinity of the break, comparatively many, much smaller squares are needed to approximate its shape. Printed resistive traces must therefore be guarded from damage.

To permit accurate measurement without requiring impractically high currents in a microcontroller-based system, resistors must have values in the range of at least several hundred ohms and thus require "square counts" typically in the range of a few dozen squares and upward. To fit such a trace on a printed (screen-printed or otherwise) blister pack requires that it be either physically large, or folded up compactly. Neither of these options may allow it to be fitted into regions of the blister pack where it is safe from damage by someone carelessly or distractedly opening a blister. The alternative is to place each resistive bridge in a location far from the blister it represents, resulting in a proliferation of low-resistance connecting traces and thus bringing back the disadvantages of the digital system.

Even given a suitable geometry and an ink with a consistent sheet resistance, a number of processing variables can affect the final resistance values. In screen printing, for example, these variables are likely to include the initial quality of the stencil, how many times it has been used, the temperature (affecting the viscosity of the ink and thus how freely it passes through the stencil), the sharpness of the rubber squeegee (affecting the pressure of the ink at the point where it is forced through), the humidity (affecting the printed surface and how well the ink wets it or spreads across it once it has passed through the stencil), and the orientation of the trace with respect to the direction in which the squeegee passes across the stencil. Stencils are also likely to vary slightly one from another, even given identical line art or Gerber files, due to differences in image development or in the stencil materials themselves.

As a result, while for a given original design all resistive traces on any given finished card are likely to have similar ratios, their actual values are likely to differ slightly between any one card and another, and more severely between cards made on successive days, on different production runs, with different stencils, and so forth. Any resistance-based analog method for blister opening detection must therefore take these differences into account.

An examination of the prior art suggests that most, if not all, such methods heretofore suggested fail to address this issue well enough for consistently reliable operation.

SUMMARY OF THE INVENTION

The present invention overcomes the deficiencies of the known prior art, as described above, through an analog approach in which the plurality of spatially extended, breakable traces behind the blisters are made from resistive, rather than highly conductive, material; the traces are connected in parallel, rather than in series, the parallel combinations being further connected in series with one or more reference resistors; traces intended to be resistive and those meant for simple interconnection are structurally and/or geometrically distinct in their construction; all of the resistive traces are formed at the same time, from the same starting materials and under the same processing conditions, in a single operation and preferably with the same orientation; all resistive traces have the same nominal line width; the variable upon which blister opening detection is based is the ratio among two resistances, as determined using the voltage divider principle, rather than the actual measured value of any single resistor; blister opening detection uses an adaptive algorithm based on the detected resistance ratios and the way they change with time, rather than on preconceived assumptions of what they "ought" to be; voltage measurement for input to the adaptive algorithm is itself measured ratiometrically based on the voltage applied to the divider, thus permitting battery-powered operation without the added drain of a voltage regulator; collected data are recorded in nonvolatile memory for later retrieval, one such entry being made at least each time the monitoring electronics detect a change in resistance representing the opening of one or more blisters; and full advantage is taken of microcontroller "sleep" or other low-power modes with voltage applied to the blister-monitoring traces only when the microcontroller "wakes," thus further conserving battery power and extending operating lifetime. Additional breakable, conductive or resistive circuit traces are desirably used to start the data recording process when the card is dispensed to the customer, for example at a pharmacy counter, and/or to detect tampering, such as attempted removal of the monitoring electronics from the blister package.

DETAILED DESCRIPTION OF THE INVENTION

Figure 5:
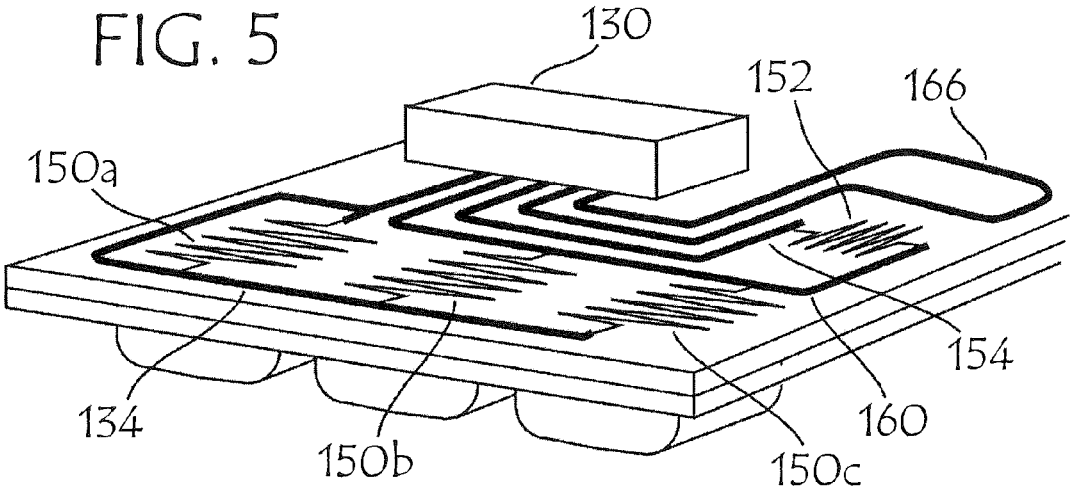
FIG. 5: a blister pack generally illustrating the invention.
Figures 6A, 6B, 6C:
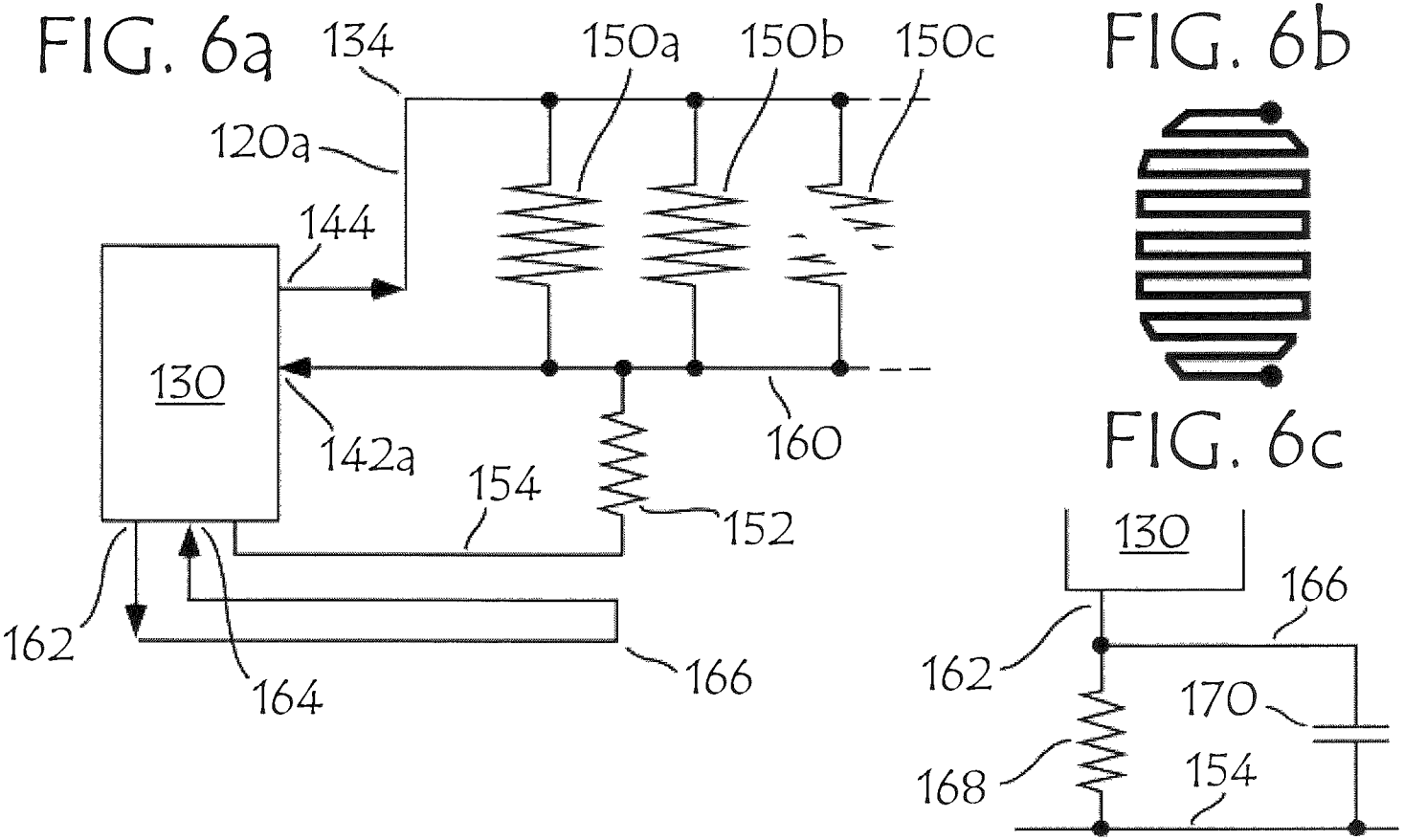
FIGS. 6*a*, 6*b*, and 6*c*: schematic diagrams generally illustrating the invention.
Figure 7:
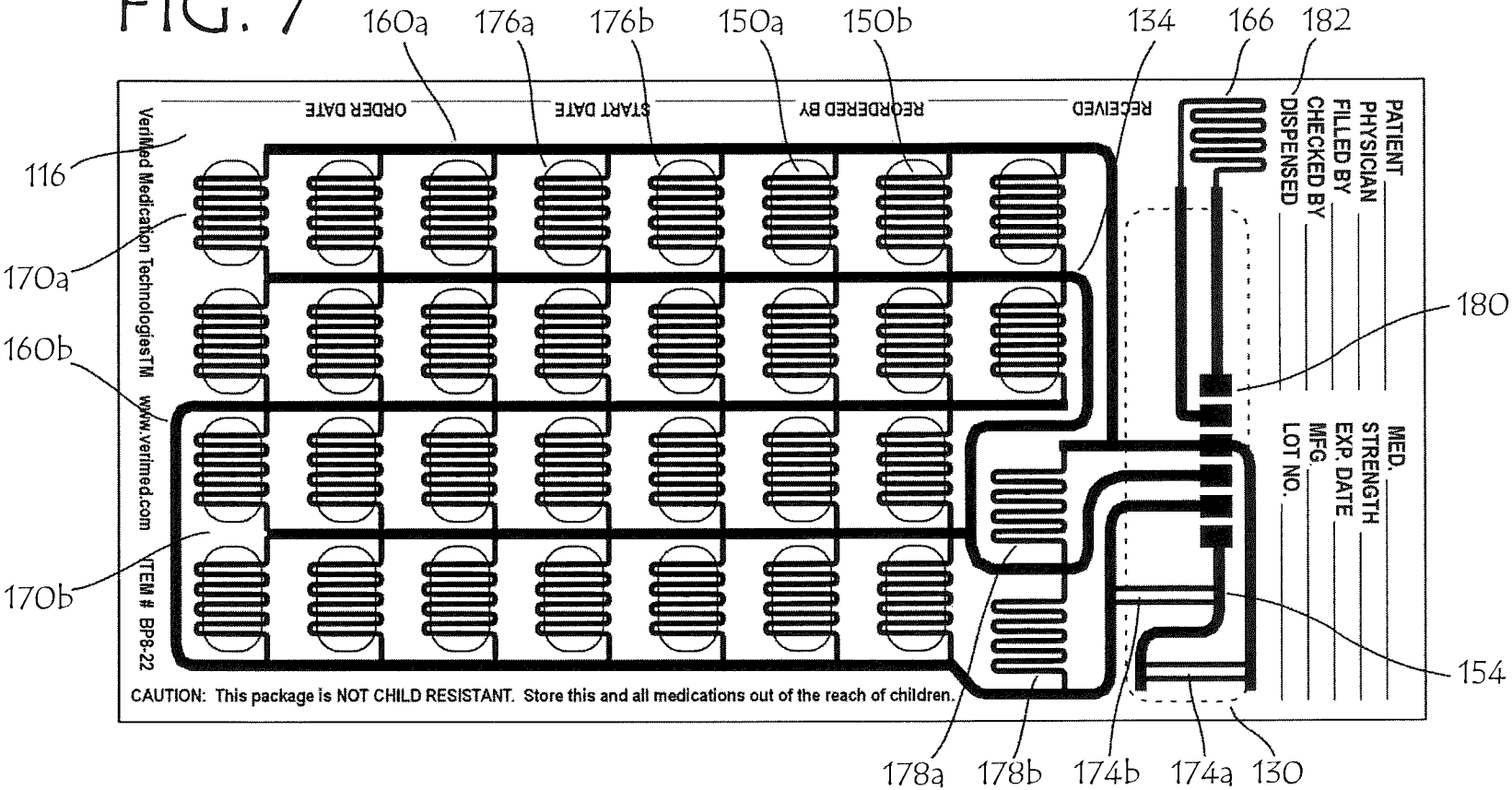
FIG. 7: a blister pack illustrating a preferred embodiment of the invention.
Figure 8:
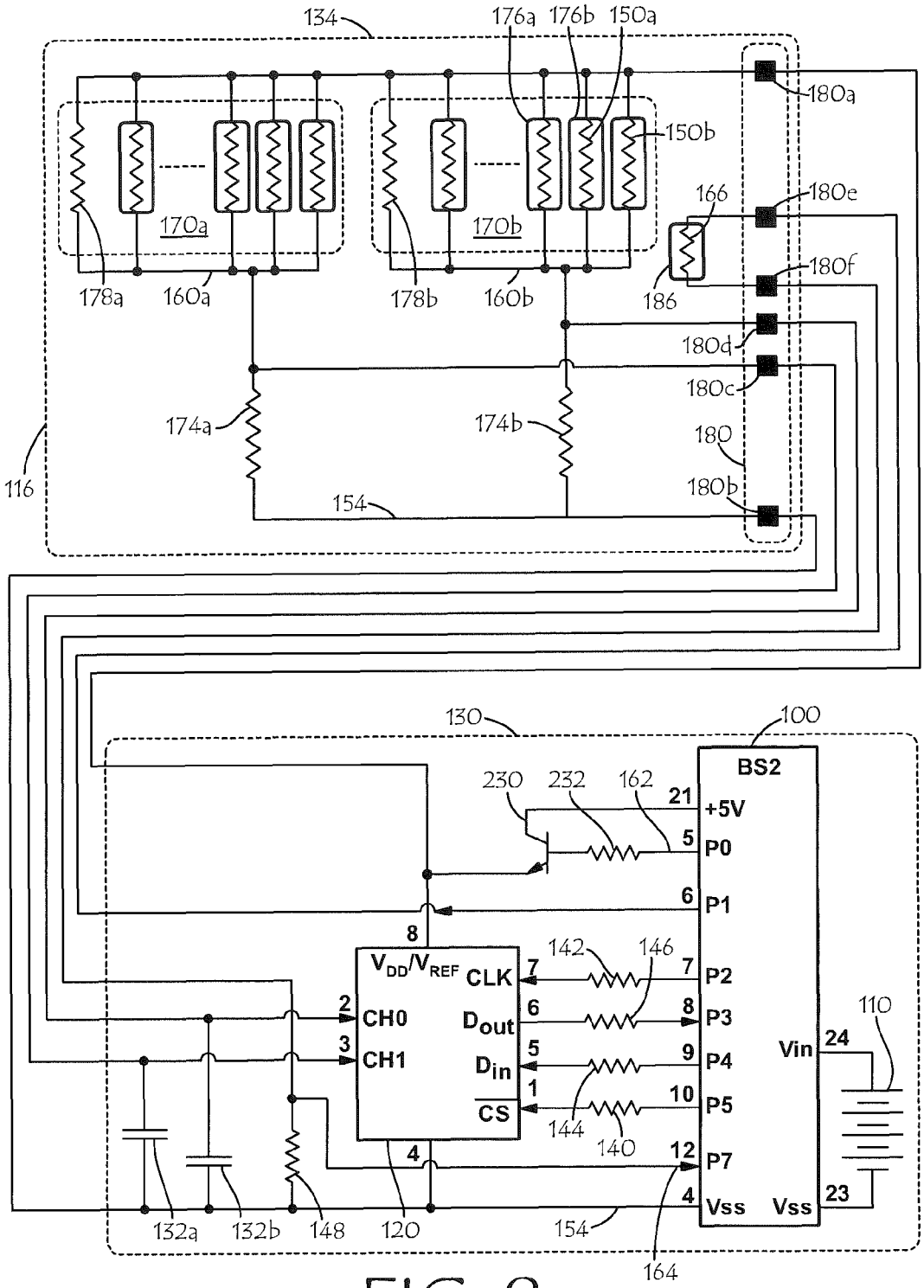
FIG. 8: a schematic diagram illustrating a specific embodiment of the invention.
Figure 9A:
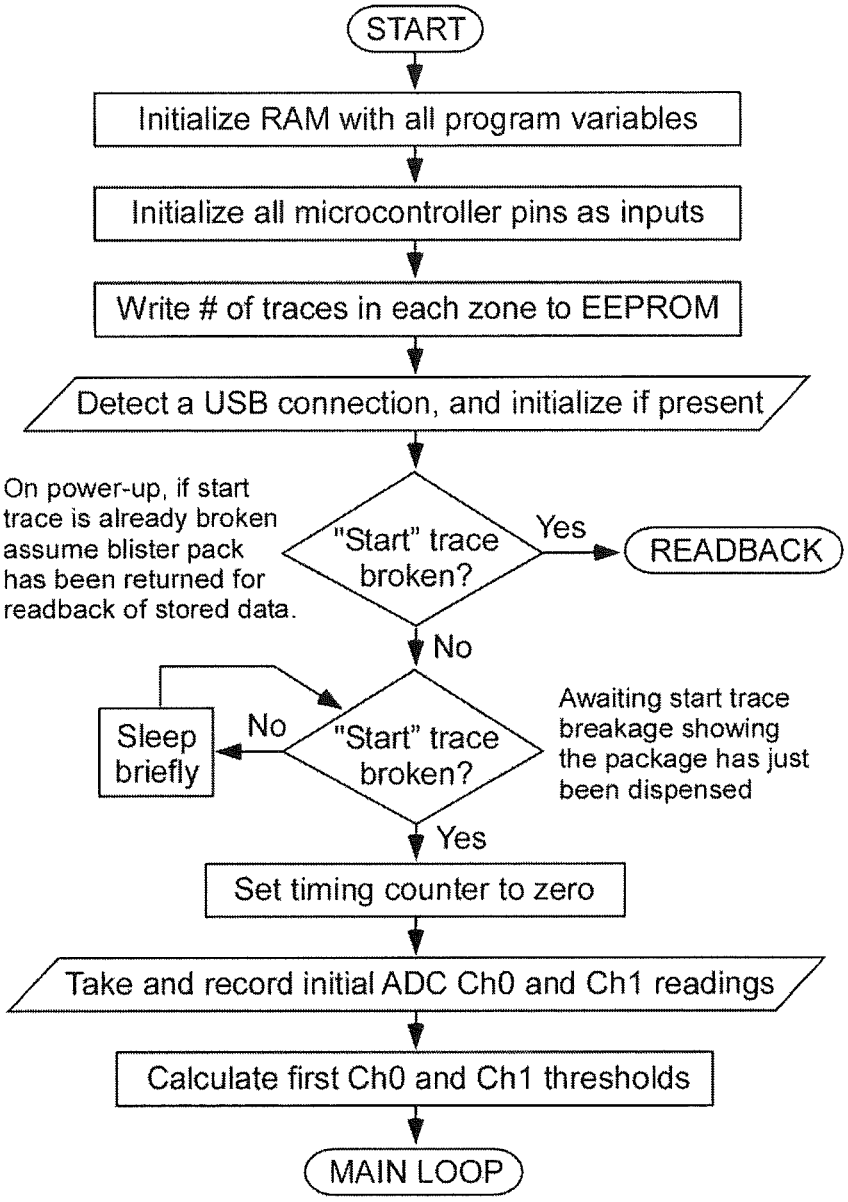
FIGS. 9A, 9B and 9C: a flow chart showing an adaptive algorithm according to the invention with the initiating loop shown in FIG. 9A, the main loop shown in FIG. 9B, and the read back loop shown in FIG. 9C.
Figure 9B:
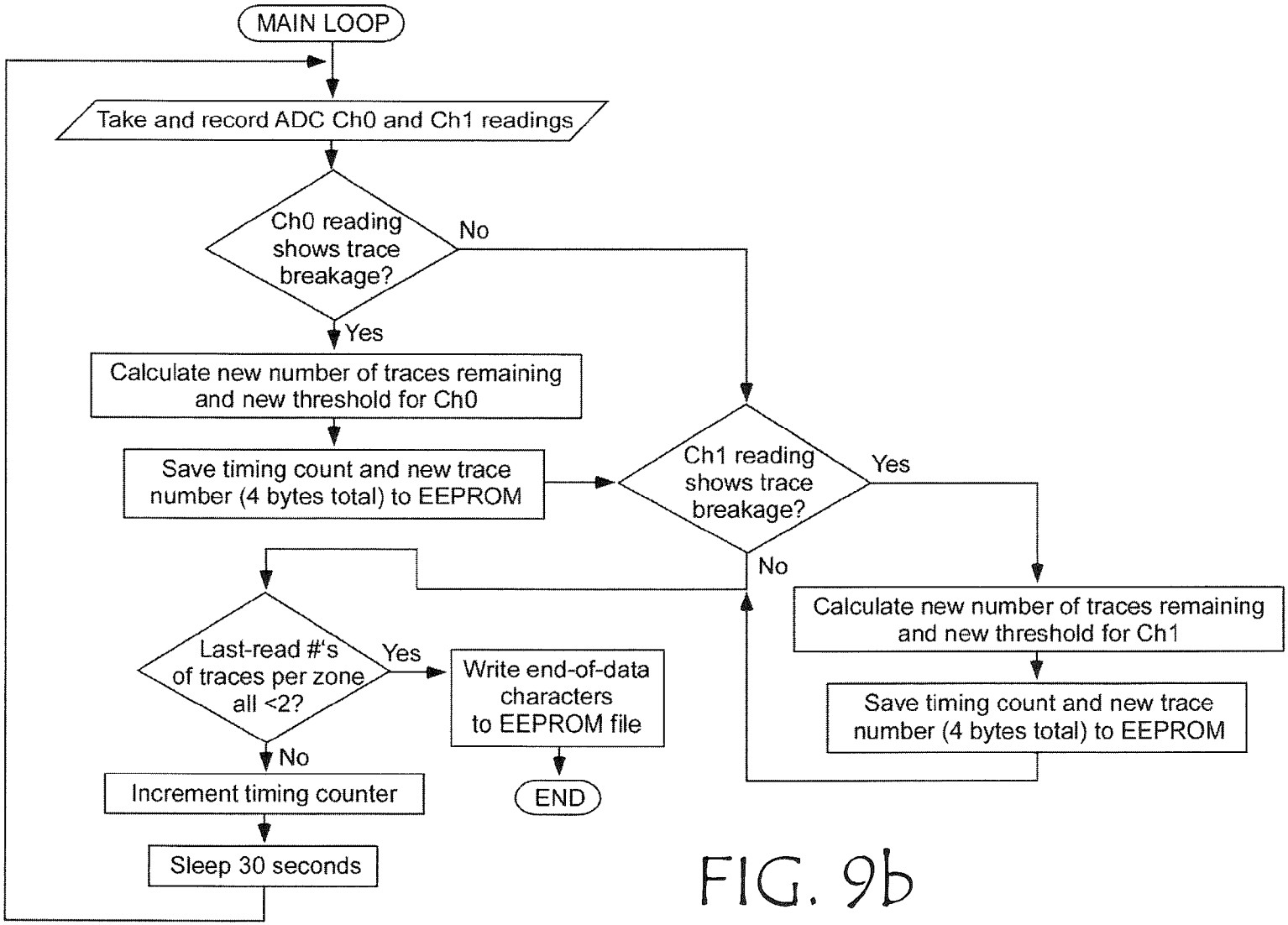
Figure 9C:
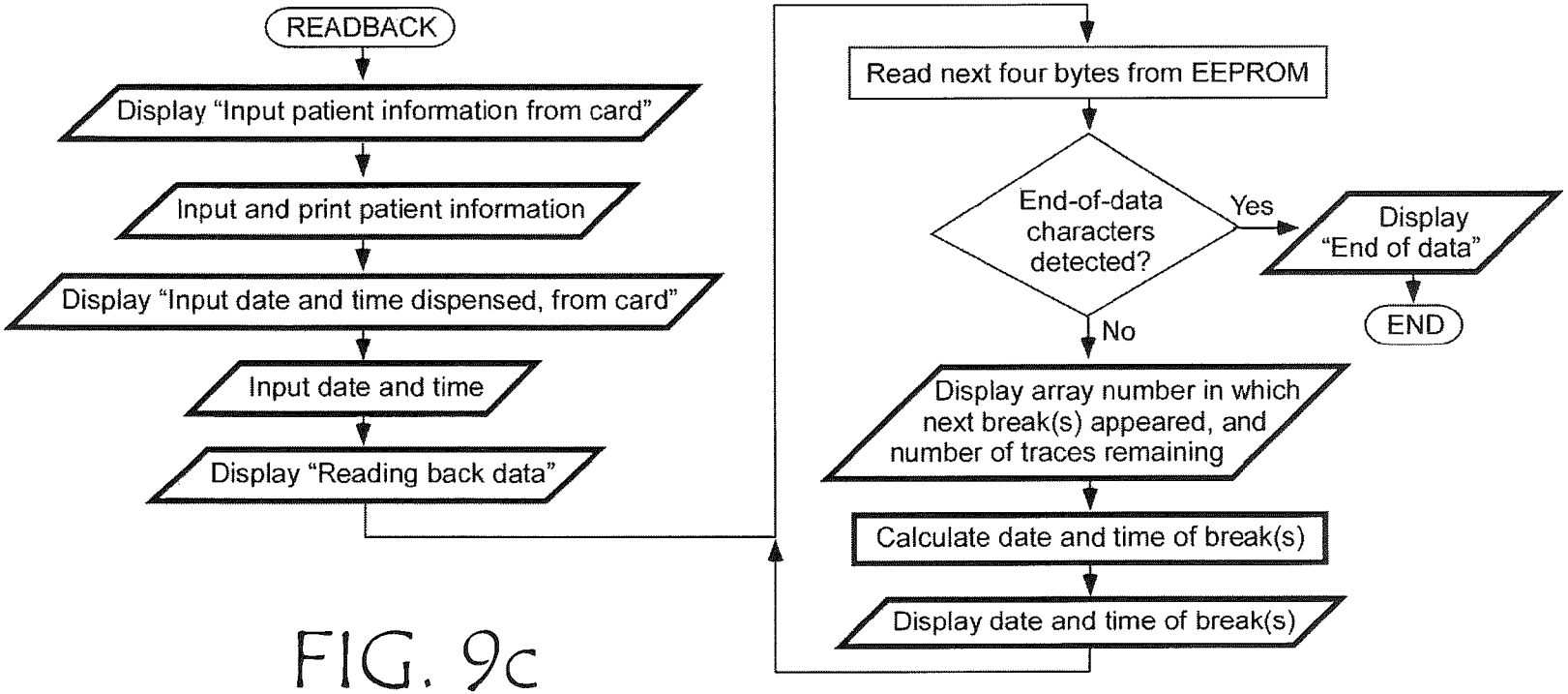

The invention, shown in FIGS. 5 and 6 with a specific embodiment shown in FIGS. 7-9, overcomes the deficiencies of the known prior art through an analog approach in which (1) the plurality of spatially-extended, breakable traces behind the blisters are made from resistive, rather than highly conductive, material; (2) the traces are connected in parallel rather than in series, the parallel traces being further connected in series with one or more reference resistors; (3) traces intended to be resistive and those meant for simple interconnection are structurally and/or geometrically distinct in their construction; (4) all of the resistive traces are formed at the same time, from the same starting materials and under the same processing conditions, in a single operation and preferably with the same orientation; (5) all resistive traces have the same nominal line width; (6) the variable upon which blister opening detection is based is the ratio among two resistances, as determined using the voltage divider principle, rather than the actual measured value of any single resistor; (7) blister opening detection uses an adaptive algorithm based on the detected resistance ratios and the way they change with time, rather than on preconceived assumptions of what they "ought" to be; (8) voltage measurement for input to the adaptive algorithm is itself measured ratiometrically based on the voltage applied to the divider, thus permitting battery-powered operation without the added drain of a voltage regulator; (9) collected data are recorded in nonvolatile memory for later retrieval, one such entry being made at least each time the monitoring electronics detect a change in resistance representing the opening of one or more blisters; and (10) full advantage is taken of microcontroller "sleep" or other low-power modes with voltage applied to the blister-monitoring traces only when the processor "wakes," thus further conserving battery power and extending operating lifetime. Additional breakable, conductive or resistive circuit traces are desirably used (11) to start the data recording process when the card is dispensed to the customer, for example at a pharmacy counter, and/or (12) to detect tampering, such as attempted removal of the monitoring electronics from the blister package.

The rationale for each feature, the part which it plays in the invention, and the advantages it brings, are explained in the following sections and illustrated in FIGS. 5, 6, 7, 8 and 9.

Making the spatially extended traces from resistive material, rather than from highly conductive material, brings a twofold advantage. First, the zig-zag, labyrinthine or otherwise spatially extended patterns needed behind blisters to ensure traces will reliably be broken when they are opened inherently satisfy the similarly labyrinthine patterns needed to form traces with high enough resistance yet good enough reproducibility for practical detection of when one trace in an interconnected plurality of such traces is broken. FIG. 5 shows one example of the placement of a plurality of spatially extended resistive traces, represented here by three traces 150*a*, 150*b* and 150*c*, behind a corresponding number of blisters in a simplified embodiment of the invention.

Second, making at least a large fraction of the trace material on the card resistive, rather than highly conductive, can reduce the overall cost since—again taking screen printing as an example of ways in which the traces could be formed—less expensive carbon-loaded, rather than silver-loaded, inks could be used. Making the spatially-extended trace behind each blister from resistive material, rather than from highly conductive material, is thus an important feature of the invention from both a functional standpoint and a cost standpoint.

Connecting the resistive traces in parallel, rather than in series, simplifies the needed circuit pattern since duplicate traces, one highly conductive and the other resistive, are no longer needed at each blister. Instead, the single trace pattern behind each blister acts both as the resistive network element corresponding to that blister, and as the detector for its opening. The resulting simplification in the overall pattern of traces both increases circuit reliability and further decreases the cost. FIGS. 5, and 6*a* illustrate the parallel connection of resistive traces 150*a*, 150*b* and 150*c* between conductive traces 134 and 160, while FIG. 6*b* illustrates the general form of a resistive trace preferred in this invention. Connecting the resistive traces in parallel, rather than in series, is thus an important feature of the invention.

In order to function properly in the invention, the resistive traces on the card must be interconnected to form the parallel network, and also connected to one or more reference resistors, formed at the same time with equal line width as described above, against which their values will be measured as ratios. Interconnecting traces must have low resistance compared to the resistive ones, preferably with at least an order of magnitude between the resistance of a resistive trace and one meant only for connection. FIGS. 5 and 6 show such interconnection in a simplified embodiment of the invention, where resistive traces 150*a*, 150*b* and 150*c* are connected in parallel by traces 134 and 160, their parallel combination is further connected in series with a reference resistor formed by trace 152, and traces 134, 150 and 152 are connected also to electronics module 130.

Most simply, the interconnecting traces may be made in the same operation as the resistive ones but relatively wider, so that even with the same sheet resistance $R_s$ and length L in the equation $$R_t=LR_s/W,$$

the larger W in the denominator will yield a lower trace resistance $R_t$.

The desired order-of-magnitude separation between trace resistances, however, may require such interconnecting traces to be too wide for optimal card layout. Hence, at least two printing operations should preferably take place in succession. Overprinting a trace with one or more identical layers lowers its resistance by a factor roughly equal to the total number of layers. If connecting traces are relatively wide compared to the resistive ones, precise registration of one layer atop the other is not critical. In this approach, all resistive and connecting traces might be formed in a first operation, and the connecting traces would then be thickened by successive operations to increase their conductivity.

Alternatively and preferably, interconnecting traces could be formed using a different material having a lower sheet resistance from that used in the resistive traces. A first operation might form the resistive traces only, and a second operation then connect them using the second material. For good connection between the two layers, some amount of overlap should be allowed at the ends of the resistive traces.

More preferably, the entire pattern of resistive and conductive traces would be formed using high-resistance material, then low-resistance material be added in a separate operation only where traces required high conductivity. Either material might be applied first, with the preferred order for any given combination of materials and substrate likely based on a modest amount of experimentation.

As yet another approach, two different processes might be used to form the resistive and conductive traces. For example, a first operation might form the conductive traces by foil stamping. A foil of sufficiently high conductivity and integrity, and without an insulating lacquer surface coating, would be required. Attempts to make electrical circuits using stamped-foil conductors usually fail since the stress of stamping opens narrow cracks in the foil. A second operation screen-printing carbon-loaded ink over all traces would then simultaneously form the resistive ones and bridge any cracks in the foil of the conductive ones, restoring continuity. The use of structurally and/or geometrically distinct, resistive and conductive traces is thus an important feature of the invention.

In analog prior art, the measured quantity which changes as blisters are opened is some voltage $V_m$ or current $I_m$ derived from the changing resistance $R_T$ and from some fixed source of voltage $V_s$ or current $I_s$ by the methods previously described. These methods are thus critically dependent on the actual values of the resistive traces, so are easily disrupted by variations in the starting materials and processing conditions. Off-nominal conditions, however, can easily occur. Again, while screen printing is here taken as an example, similar process variables will likely have analogous effects in other printing processes as well.

While a few premium resistive ink products, such as Conductive Compounds' VRI Series, claim ±5% reproducibility in sheet resistance from batch to batch, manufacturers normally guarantee only some maximum value, such as 50 ohms per square. Actual sheet resistances, after correct processing, are merely guaranteed to be less than this value. Sheet resistances may also vary within a single batch or even a single container of ink, due to more or less thorough mixing or settling out of the conductive particles, evaporation of solvent, aging of the binder material, and possibly other factors.

Since ink is forced through the stencil under pressure, often using a rubber squeegee, some of it may flow sideways into unwanted areas after passing through. Depending on the quality and age of the stencil, on the orientation of the stencil openings with respect to the direction of squeegee motion, and especially if the edge of the squeegee is growing worn and blunt, excess ink may pass through the openings and form traces a little wider than the actual gaps in the stencil. Especially with very fine traces, this may have a significant effect on resistance. Forming all of the resistive traces at the same time, from the same starting materials and under the same processing conditions, in a single operation and preferably with the same orientation, is thus an important part of the invention.

Stencil and squeegee wear, substrate conditions and many other factors can affect the width and resistance of traces. Keeping all resistive traces in the invention the same nominal width mitigates these effects, as shown in Table 2. Traces 1 and 5 from Table 1 have different dimensions but the same nominal resistance if made under nominal conditions: $R_5/R_1=1.0$. If corresponding traces 1a and 5a are made with 40-ohm-per-square ink but at nominal widths, their resistances still remain equal. With a blunted squeegee or worn stencil, however, the excess ink and resulting trace broadening have a disproportionate effect on the resistance of the narrower trace, making the resistances of the two traces no longer equal.

TABLE 2

| Trace | Length, millimeters | Width, millimeters | Squares | Ink sheet resistance, ohms/sq | Total trace resistance, ohms | $R_5/R_1$ |
|---|---|---|---|---|---|---|
| 1 | 100 | 0.5 | 200 | 50 | 10,000 | 2.0 |
| 5 | 200 | 1.0 | 200 | 50 | 10,000 | |
| 1a | 100 | 0.5 | 200 | 40 | 8000 | 2.0 |
| 5a | 200 | 1.0 | 200 | 40 | 8000 | |
| 1b | 100 | 0.6 | 167 | 40 | 6667 | 1.09 |
| 5b | 200 | 1.1 | 182 | 40 | 7280 | |

Even granted all of the preceding requirements, there will inevitably still be some small variation among resistive traces formed on a card. This variation may result from inconsistencies from one part to another of the original line art used to create the stencil, of the quality of focus in the light typically used to transfer the line art to the stencil material, of the stencil starting material, or of the developing conditions used to translate the pattern of light exposure on the stencil material into openings in the finished stencil. To quantify the amount of variation likely to remain, the resistance values of thirty nominally identical traces having the form shown in FIG. 6*b* were measured using an Agilent U1242A, four-digit hand-held multi-meter. Traces were printed with carbon-loaded ink on drafting vellum, each having the form shown in FIG. 6*b* with an approximate line width of 0.8 millimeter and length of 220 millimeters. The results are shown in Table 4, with the locations of readings in the table representing the locations of the respective traces on the prototype card.

TABLE 3

| | | | | | | | |
|---|---|---|---|---|---|---|---|
| 22.12 | 24.61 | 24.85 | 25.08 | 24.54 | 24.34 | 22.66 | 24.44 |
| 22.29 | 24.01 | 25.28 | 24.07 | 23.60 | 24.19 | 21.70 | 24.02 |
| 25.59 | 24.13 | 24.85 | 23.18 | 22.53 | 23.81 | 24.12 | — |
| 25.44 | 24.47 | 23.53 | 25.34 | 23.08 | 25.66 | 22.87 | — |

All resistances are in kilo-ohms.

| | | |
|---|---|---|
| Maximum: 25.66 | Minimum: 21.70 | Mean: 24.013 |
| Max/mean: 1.063 | Min/mean: 0.937 | Standard Deviation = 1.058 |
| (mean + 6.3%) | (mean − 9.63%) | (4.41% of mean) |

As can be seen, while the measured values are not all the same, they do cluster in near-Gaussian fashion around a mean value near 24,000 ohms, with a standard deviation less than ±5% and no readings further than ±10% from the mean. This strongly suggests that traces having the same width and overall geometry, formed at the same time and on the same surface under the same process conditions, will always have consistent resistances. Keeping all resistive traces the same nominal width is thus an important feature of the invention.

So long as the correct ratios in the numbers of squares forming the resistors are maintained—even if the actual number of squares is different—and the ink is well enough mixed to have a consistent sheet resistance, the resistance ratios will likewise be maintained.

As an example, let $R_{12}=R_2/R_1$, where $R_1$ and $R_2$ are the resistances of Traces 1 and 2 in Table 1 respectively. As shown in Table 3, if both traces are formed under nominal conditions the resistance of Trace 2 is just twice that of Trace 1. In mathematical terms, $R_2/R_1=2.0$.

TABLE 4

| Trace | Length, milli-meters | Width, milli-meters | Squares | Ink sheet resistance, Ω/square | Total trace resistance, ohms | $R_2/R_1$ |
|---|---|---|---|---|---|---|
| 1 | 100 | 0.5 | 200 | 50 | 10,000 | 2.0 |
| 2 | 200 | 0.5 | 400 | 50 | 20,000 | |
| 1a | 100 | 0.5 | 200 | 40 | 8000 | 2.0 |
| 2a | 200 | 0.5 | 400 | 40 | 16,000 | |
| 1b | 100 | 0.6 | 167 | 40 | 6667 | 2.0 |
| 2b | 200 | 0.6 | 333 | 40 | 13,333 | |

If in some actual process run, ink with a sheet resistance of only 40 ohms per square is used, the resulting traces 1a and 2a will have lower resistances as shown in Table 2 but the resistance ratio between them will remain unchanged.

If by the end of that long run the squeegee is also in need of sharpening or the stencil is worn, causing a heavier deposit with trace widths 0.1 millimeter greater than nominal, the resulting traces 1b and 2b will have still lower resistances. Again, in any single card, the ink and the processing conditions are consistent from trace to trace, so the ratio will still remain unchanged.

The ratio between two resistances is conveniently measured by connecting the resistors as a voltage divider, again as illustrated in FIGS. 5 and 6*a* for a simplified embodiment of the invention. Breakable traces 150*a*, 150*b* and 150*c*, all connected in parallel between traces 134 and 160, form one of the two resistances whose ratio is to be found. Additional resistive traces may be present as indicated by the dashed lines extending to the right from the ends of traces 134 and 160. Reference resistor 152 is connected in series with the parallel array, leading to a trace 154 which itself is preferably connected to system ground.

The ratio of the parallel combined resistance $R_p$ of traces 150*a*, 150*b*, 150*c* and so forth to the resistance $R_1$ of reference trace 152 is conveniently found by connecting trace 160, from the node joining the parallel combined resistance to the reference resistance, to an analog input 142*a* of electronics module 130, and placing a known voltage $V_s$ between traces 134 and 154. The ratio $R_p/R_r$ is then easily found using the voltage-divider equation $$R_p/R_r=(V/V_i)-1,$$

where $V_i$ is the voltage read at input 142*a*. Measuring the ratios of resistance between resistive traces or combinations thereof, for example using the voltage-divider principle, rather than necessarily measuring the actual value of any single resistor, is thus an important feature of the invention.

Given the data presented above, while measurement of resistance ratios rather than actual resistances will compensate for most processing differences which can affect resistance, it is not a full solution. The use of an adaptive algorithm, based on the detected ratios and the way they change with time rather than on preconceived assumptions of what they "ought" to be, helps resolve any remaining errors.

If n identical resistances placed in parallel have a combined value $R_p$, each individual resistance $R_t$ is simply n times $R_p$. Hence the ratio between any single $R_t$ in the parallel array of 150*a*, 150*b* and so forth and the reference resistance IR, is given by $$R_t/R_r=n_0[(V_s/V_0)-1],$$

where $n_0$ is the original number of parallel resistances and $V_0$ is the voltage read at input 142*a* before any blisters are broken. Since $R_t/R_r$ is invariant for any given card, it is convenient to determine it just once before any traces are broken and set it as a calculated program constant, hereafter to be called simply Q.

Once Q has been found for the card, and assuming $V_s$ remains constant, it is easily shown that at any later time x the voltage $V_x$ at input 142*a* depends only on Q and the number of traces $n_x$ remaining:

$$V_x=V_0(Q/n_0+1)/(Q/n_x+1)$$

and therefore, $$n_x=Q/[(V_0/V_x)(Q/n_0+1)-1].$$

As can be seen, this expression depends only on the measured values of $V_0$ and $V_x$, the calculated Q and the already known $n_0$, and not on the actual resistive values of any of the traces.

After determining Q, the microcontroller calculates a voltage threshold corresponding to $n_0-0.5$ traces remaining: that is, halfway between the presently read voltage and the one expected after the next single trace breakage:

$$V_{th}=V_O(Q/n_0+1)/(Q/(n_0-0.5)+1)).$$

At each subsequent read cycle, voltages above this threshold are read as "no change" and trigger no action. If a voltage lower than the threshold is read, and proves through repeated readings not to be simply a noise artifact, the microcontroller records the new voltage; calculates the number of traces remaining, rounds that number to the nearest integer (since only whole traces can be broken); finds from that the number of traces broken since the last reading; records the time and the number of traces broken in nonvolatile memory; then calculates a new threshold representing the further breakage of 0.5 trace and repeats the cycle. When all traces located behind blisters on the card have been broken, the microcontroller shuts down.

Calculating the next trace detection threshold from each actually recorded input voltage, rather than relying on pre-calculated values, helps to eliminate any error resulting from variations in trace resistance values. Since only in exceptional cases (assuming correctly designed trace layout) will a blister-monitoring trace be damaged only enough to change its resistance without being broken entirely, it is a reasonable assumption that n at any given time will be an integer. Having the algorithm calculate each new n and then round it to the nearest integer provides a further way to screen out any error resulting from trace mismatch. The use of an adaptive and self-correcting algorithm of this nature is thus another important feature of the invention.

Since at least in a battery-powered application the battery voltage typically falls off with time, for the method just described to work Vs will either need to be stabilized through some sort of regulation, or allowed to change while some form of compensation for the changes is made in the control circuitry. Voltage regulation is well-known in the art of power supply design, but a voltage regulator itself requires a small amount of current for its operation, placing an extra burden on the battery and thus shortening its life.

A simple way to permit Vs to change without affecting measurement accuracy is to take all voltage measurements, just like all resistance ones, as ratios rather than as exact values. It is easily seen from the voltage divider equation $R_p/R_r=(V_s/V_i)-1$ that for any given value of $R_p/R_r$, as $V_s$ changes, $V_i$ will also change in direct proportion to keeping $V_s/V_i$ constant. If the device chosen to digitize $V_i$ for input to the control system is ratiometric and fed with the same voltage $V_s$ that is applied to the divider, its digitized output will represent fractions of $V_s$ and thus each possible reading will represent some particular ratio between $R_p$ and $R_r$ from which n can be determined as previously explained.

A practical example of such a ratiometric converter is the Microchip MCP3202, dual channel twelve-bit analog-to-digital converter (ADC). This is a complete successive-approximation converter built into an 8-pin integrated circuit. A single pin doubles as the power supply and the reference input, so the digital output for each channel represents the respective channel input as a binary fraction of the supply voltage:

$$D_{out(bin)}=4096*V_{in}/V_{REF}.$$

Connecting the supply and reference pin to the positive end of the voltage divider, as shown in FIG. 7, thus permits measurements of resistor ratios to be taken directly:

$$D_{out(bin)}=4096*R_r/(R_p+R_r).$$

This value remains accurate regardless of the actual value of $V_s$ so long as it remains between 2.7 and 5.5 volts DC, the permissible supply voltage range for the MCP3202.

Other ADC's in the same family, or in similar ones from different manufacturers, offer larger numbers of channels with similar functionality. For example, the MCP3204 and MCP3208 offer four and eight input channels respectively. It is also possible, of course, when using ADC's external to the microcontroller to connect a plurality of them to it. The measurement of voltages for input to the adaptive algorithm using a ratiometric data converter is thus another important feature of the invention.

Since the purpose of the invention is to monitor the opening of blisters in a package and determine the times at which such opening occurs, it is difficult to predict how long data collection will have to continue. A forgetful or absent-minded patient may lose a card whose medication has been only partly dispensed, then find it again at some later time. It is desirable, therefore, to extend battery lifetime as much as possible given the requirements of the monitoring system.

Present technologies used to provide memory to microprocessors and microcontrollers fall into two broad categories, volatile and nonvolatile. Volatile memory is typically fast, making it well-suited for use in computation, but requires power to maintain its contents and goes blank if the power is lost. Since it is uncertain how long the blister-pack monitor will need to retain data before it can be read back, nonvolatile storage is a better choice.

Ongoing advances in solid-state memory have made EEPROM and flash memory nearly ideal ones for use in the invention, since their only downside, their slowness when compared to RAM, is of only trivial importance when only small amounts of data need to be recorded at relatively long intervals. Battery-backed static RAM could alternatively be used, provided the useful life of the battery is sufficient to allow data retention. Phase-change memory offers further possibilities. Data corresponding to many days, months or even years of use can thus be stored, then read back when the device is returned to a pharmacy or other facility for uploading to a host computer. The use of nonvolatile storage for the collected data is thus another important feature of the invention.

Most microcontrollers designed for battery-powered operation include "sleep" and other low-power modes in which no processing takes place and battery drain is reduced to a small fraction of its value when the processor is "awake."

In the invention the processor turns on $V_s$ initially just long enough to find Q and $V_{th}$ and store them in memory, then turns off $V_s$ again and enters a low-power mode. After a preset interval (nominally thirty seconds, although a different interval could alternatively be used) it "wakes" again, turns on $V_s$, samples $V_{in}$ through the ADC, turns $V_s$ off again, compares the freshly measured $V_{in}$ with the previously stored $V_{th}$, and based on the results performs any needed further calculation and data storage in memory before going back into low-power mode.

This process is repeated until the breakage of all blister-monitoring traces has been detected. As a result, full power is used for only a few milliseconds out of each typically 30-second timing cycle. Taking full advantage of "sleep" or other low-power modes in the microcontroller chosen, and applying power to the voltage divider containing the blister-monitoring traces only when the processor "wakes," thus conserving battery power and extending operating lifetime, is thus another important feature of the invention.

Many microcontrollers include built-in timekeeping features, such as real-time clocks programmable with the current year, month, date, hour, minute and second. To run these features, however, requires power and may not permit entry into the lowest-power "sleep" modes. The invention includes an optional feature providing an alternative to using these features, if present. When using this option, an extra "start trace" 166 is added to the card as shown in FIGS. 5 and 6*a*, driven by a dedicated digital output pin 162 on electronics module 130 and monitored by a digital input pin 164 which, if no current flows in trace 166, is pulled to a designated logic state either by its own internal circuitry or, if needed, by a resistor connected to that logic level.

Trace 166 may simply be a shorting jumper mechanically connected between pins 162 and 164 of the module as it comes from the factory, with timekeeping started by removing this jumper when module 130 is attached to the blister package. Alternatively, and preferably if there may be delays between when some blister packages are made up and when they are dispensed, trace 166 is an actual conductive trace formed on surface 116 close by an edge of the card in a location where it can easily be broken, for example with an ordinary paper punch. In such a case, module 130 is attached to the card and the shorting jumper is then removed, leaving trace 166 on the card bridging pins 162 and 164 until it is cut at the actual time of dispensing.

Before the card is dispensed, electronics module 130 runs a short timing loop in which the microcontroller "wakes" just long enough to set pin 162 in the opposite logic state from pin 164's normal one if not driven through trace 166. Pin 164 is then read. If trace 166 remains continuous, the logic state at pin 164 will be the same as on pin 162; if not, then the opposite state. By breaking trace 166, the pharmacist signals the electronics module that the card is being dispensed. At the same time, the date and time the card is dispensed should be recorded on it in humanly readable form.

On sensing that start trace 166 has been broken module 130 enters its main timing cycle, ready to record when the blisters on the card are opened. The timing cycle in this case includes a time variable which is incremented each time the cycle runs, regardless of whether blisters have been opened or not. The count in this variable, equal to zero when the card was dispensed and steadily increasing thereafter, provides a marker of time which is recorded to show when each blister has been opened. For example, using a 24-bit variable together with a 30-second timing cycle permits timekeeping up to 16,777,215 cycles, or just short of 16 years: surely adequate for any conceivable use of the invention.

FIG. 6*c* shows an alternative way to implement the "start trace" feature, requiring only a single bidirectional I/O pin 62. Resistor 168 is connected to trace 166 close to I/O pin 162, while a small capacitor 170, in the sub-microfarad range and preferably with a value on the order of 0.01 microfarad, is connected to the opposite end of trace 166. The opposite ends of resistor 168 and capacitor 170 are tied to known logic levels. For example, both may be tied to system ground 154, representing a logic "zero," as shown.

On "waking," the microcontroller sets pin 162 as an output long enough to charge capacitor 170, again to the opposite logic state from the one toward which pin 162 would be pulled by resistor 168 or otherwise if no current passed through trace 166. Pin 162 is then set as an input, and immediately read. If trace 166 is unbroken leading to capacitor 170, the logic state read is the same one just sent out. If trace 166 has been broken, conversely, capacitor 170 is not connected to pin 162, the opposite logic state is read, and the microcontroller again enters its main program ready to record when blisters are opened.

The use of a "start trace" which is broken to start the data recording process when the card is dispensed to the customer, for example at a pharmacy counter, is an optional but desirable feature of the invention.

Tampering with electronically-monitored blister packages would not normally be expected, but cannot be ruled out. For example, if a blister package held narcotics or other substances with high street value, a thief might attempt to substitute a counterfeit card, switch module 130 onto it and leave the real card unmonitored and its contents available for resale. Adding electronic tamper detection at least would make such transfer more difficult, giving improved security.

One or more security traces, similar in structure and function to trace 166, may be run around the rim of the card or otherwise as an anti-tampering feature, and checked frequently. As with the start trace, this could be performed on a much shorter time cycle than reading the number of traces broken since no calculation would be needed.

So long as all traces remain continuous between the pins they are meant to connect (not shown in the Figures) they will provide assurance to the microcontroller that the module has not been removed from the card. If these traces are disturbed, the microcontroller will record an alarm message to memory.

It is possible, however, that detection of the breakage of a simple conductive security trace could be defeated through use of a wire jumper or metal tape placed across the connecting pins before other tampering takes place. A more foolproof method, usable either alone or along with the conductive security traces already described, is to add one or more extra resistive security traces, connected in parallel with traces 150*a*, 150*b* and so forth but placed where they will not be broken when blisters are opened.

Unlike simple conductive traces, resistive ones cannot be defeated by wire jumpers since either breaking them or shorting them out will change the number $n_x$ of resistive traces detected. With suitable programming, the resistance of such a trace need not be the same as that of the traces meant to be broken when blisters are opened; in other words, $n_x$ when calculated from the equation $$n_x = Q/[(V_0/V_x)(Q/N_0+1)-1]$$

need not be an integer.

To defeat this method of security, a tamperer would first need to determine (at least to a close approximation) the resistance of the security trace without removing it from the circuit. Given that many other resistive traces are connected in parallel with it, this is not a trivial task. The tamperer would then have to disconnect the card from the electronics module and immediately bridge traces 134 and 160 with a jumper containing a like-valued resistor, completing this substitution during the interval between two successive readings of the resistance of the parallel array.

Adding conductive or resistive traces which will be interrupted in the case of tampering, making such tampering evident, is an optional but desirable feature of the invention.

Figure 1:
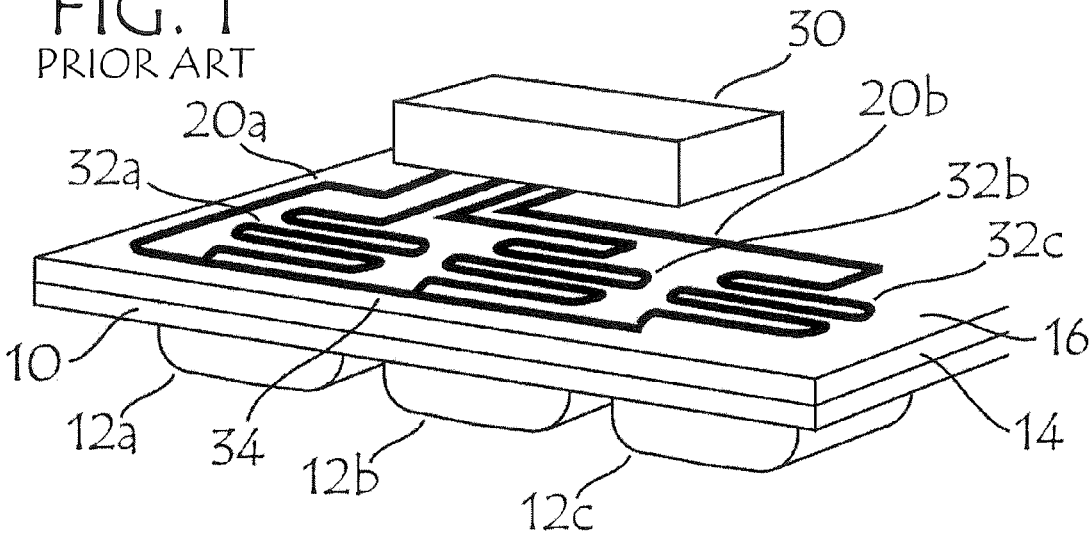
FIG. 1 PRIOR ART
FIG. 1: a blister pack according to the prior art typifying the common approach referred to herein as "digital."
Figure 2:
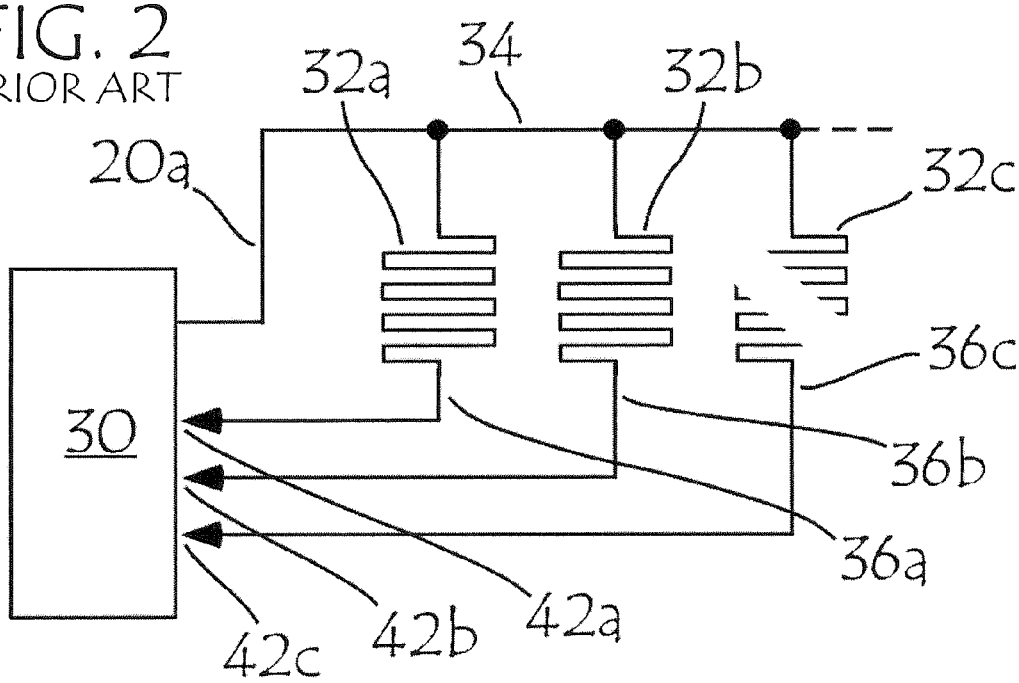
FIG. 2 PRIOR ART
FIG. 2: a schematic diagram according to the prior art typifying the digital prior-art approach.
Figure 3:
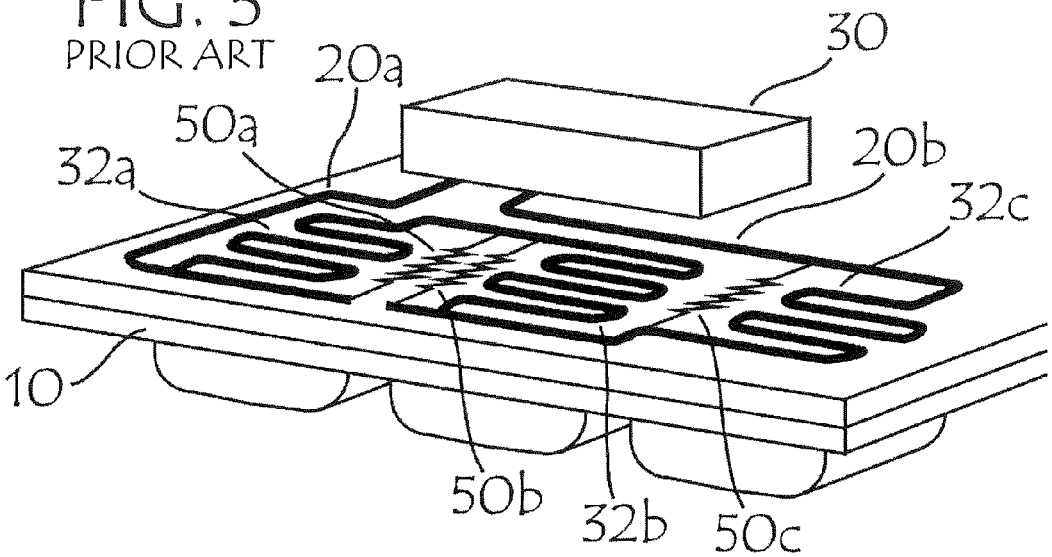
FIG. 3 PRIOR ART
FIG. 3: a blister pack according to the prior art typifying the common approach referred to herein as "analog."
Figure 4:
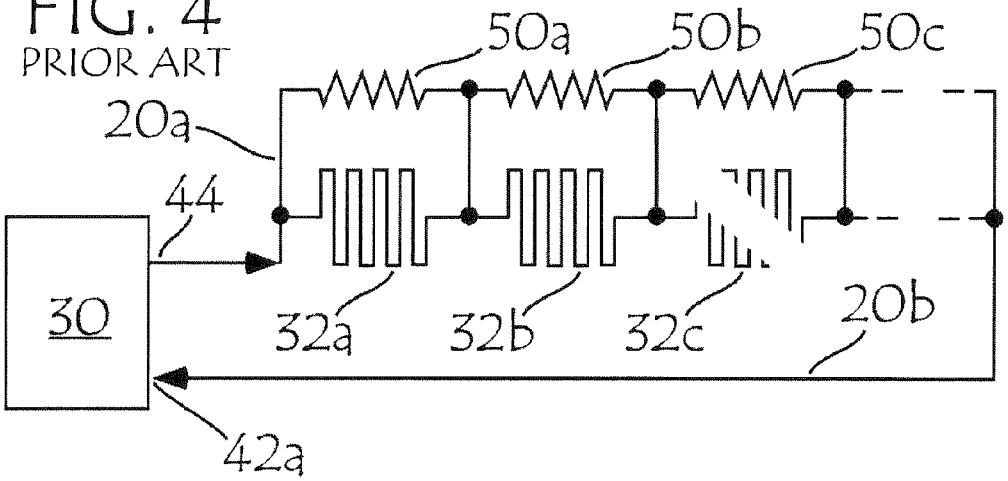
FIG. 4 PRIOR ART
FIG. 4: a schematic diagram according to the prior art typifying the analog approach.

FIG. 7 illustrates a blister package according to the present invention comprising blisters (not shown in FIG. 7 but similar to those shown on FIGS. 1, 3, and 5) on the rear of the surface 116 bearing conductive and resistive traces, where outline 130 represents the location of the electronics module.

Resistive traces such as 150*a* and 150*b*, all having at least approximately the same resistance through having been formed from the same materials, under the same process conditions and in a single operation as has been previously discussed, are divided into a plurality of zones. This example has two zones generally indicated by 170*a* and 170*b*, where zone 170*a* contains eight blisters and zone 170*b* contains twenty-two blisters. It should be understood, however, that virtually any number of resistive traces could be used, divided in any desired way among one or a plurality of zones.

The resistive traces in zone 170*a* are all connected in parallel between trace 134, to which a first known voltage is applied at least intermittently, and trace 160*a*. One or a plurality of resistive traces 174*a* further connects trace 160*a* to trace 154, to which a second known voltage is applied at least intermittently. This second voltage is preferably the system ground for electronics module 130, and trace 154 preferably remains connected to it continuously.

The traces in zone 170*a* thus form one half of a voltage divider fed by traces 134 and 154; trace or traces 174*a*, the other half; while trace 160*a* forms the output. Similarly, the resistive traces in zone 170*b* form one half of a second voltage divider, also fed by traces 134 and 154; trace or traces 174*b*, the other half; and trace 160*b*, the output.

It should be noted that the lines of resistive material forming all resistive traces are preferably all of the same width and all placed at least principally in the same orientation—shown in FIG. 7 as horizontal—so as to minimize the effect of process variations on the resulting resistance ratios.

A wide range of resistance values can be attained by connecting the same traces in various ways, either in series or in parallel. It should be stressed that in this invention the actual value of each resistor 174*a* or 174*b* is not critical, nor is its exact ratio with the combined parallel traces in the corresponding zone 170*a* or 170*b* when all are unbroken. All that matters is that the ratio can be measured, recorded, and used as a basis for later calculations. Resistors 174*a* and 174*b* may thus have any convenient value which can be achieved using the same process which forms those in the corresponding parallel zone. The margin for error becomes wider, however, and the mathematics can also be made slightly simpler, if the value of each of these resistors lies between the combined parallel resistance value of the zone and a few tenths of that value.

For example, traces in the sample previously described had line widths of about 0.8 millimeter and lengths of about 220 millimeters, yielding resistances of about 109 ohms per millimeter with an average resistance of 24,013 ohms per trace. Combining twenty-three such equal resistances (twenty-two corresponding to blisters plus one more for security) in parallel to form zone 170*b* yields a combined resistance of 1044 ohms. Keeping the same line width for trace 174*b* requires a length of only 9.6 millimeters to attain this same resistance. Similarly, combining nine equal resistances of 24,013 ohms per trace in parallel (eight for blisters plus one for security), yields a combined resistance of 2668 ohms, requiring a trace length of 24.5 millimeters. Smaller resistance values would require even shorter lengths.

At short trace lengths, however, small differences in registration between the conductive and resistive traces or minor flaws in the stencil could have disproportionate effects on the actual resistance values. It may be preferable, therefore, to form resistors 174*a* and 174*b* from multiple, parallel traces each having a substantially higher resistance. For reproducibility, and to ease trace reconfiguration if the division of blisters between zones needs to be changed to accommodate a different dosing schedule, it is further preferable to have all voltage dividers designed alike. As a result in FIG. 7 each of resistances 174*a* and 174*b* is shown as a pair of traces, each having the same line width as those forming resistances 150*a*, 150*b* and so forth, with the pair then connected in parallel.

Each resistive trace such as 150*a* or 150*b* meant to detect the opening of a blister lies directly behind that blister (not shown in FIG. 7) and preferably overlaps an outline such as 176*a* or 176*b*, corresponding to the blister's edge and deliberately weakened, for example by partial-thickness die cutting, so that in opening the blister a person will almost certainly break the resistive trace in one or more places where it overlaps that outline.

Additional security is provided by resistive traces 178*a* and 178*b*, one connected in parallel with the resistive traces in each of zones 170*a* and 170*b*, again as has been previously discussed.

Upon application of the first and second known voltages to traces 134 and 154, voltage-divider action produces a first resulting voltage on trace 160*a*, and a second resulting voltage on trace 160*b*, each voltage representing the number of traces remaining unbroken in the corresponding zone, once again as has been previously discussed.

In addition, a "start" trace 166 is placed near one edge of the card where it can easily be cut, for example by using a paper punch, when the card is dispensed. Trace 166 may be formed from resistive material, conductive material, or a combination of them.

A field of connection pads, prongs, sockets or other connection means, as are well-known in the art of electrical and electronic connection, generally indicated by 180, receives the ends of traces 134, 154, 160*a*, 160*b*, and 166 and connects them with electronics module 130, here indicated by a simple outline showing where the module would be located when mounted on surface 116.

Legending 182 printed either directly on surface 116, or preferably on another layer of thin, nonconductive and more preferably opaque material (not shown) placed over it except where contact is made to connection means 180, includes blanks for all needed information, including the date dispensed. Most preferably, the "dispensed by" legending is printed directly adjacent to trace 166 as a reminder to the pharmacist to punch out or otherwise break trace 166 at the time the package is dispensed.

Alternatively, or in addition, some or all of the information shown could be recorded in electronically-readable format such as a magnetic stripe, a printed one- or two-dimensional barcode, or directly in the nonvolatile memory in module 130.

FIG. 8 shows the preferred embodiment in schematic diagram form.

Symbols placed within dashed outline 116 represent conductive or resistive traces on the card which physically bears nonconductive surface 116. Resistive traces such as 150*a*, 150*b*, 174*a* and 174*b*, zones such as 170*a* and 170*b*, conductive traces such as 134, 154, 160*a* and 160*b*, start trace 166, and connection means 180 function as previously described. Solid outlines such as 176*a*, 176*b* and 186 placed around components indicate that those components are intended to be broken during use of the blister pack, while components without such outlines are intended to remain intact.

Symbols placed within dashed outline 130 represent components within electronics module 130. All functions in block 130 are preferably controlled by a microcontroller 100. For the purposes of this Description, microcontroller 100 is assumed to be a Parallax BASIC Stamp™ since that was the type chosen for first reduction of the invention to practice. Pin numbers shown for the microcontroller in FIG. 8 are those of the BASIC Stamp. It should be understood, however, that virtually any microcontroller and any compatible assembly or high-level programming language could be used, with one allowing either floating-point arithmetic, and/or integer variables larger than the Stamp's 16 bit maximum, preferred.

Microcontroller 100 and other electronic components in the invention are powered by a battery 110. This may be any battery type offering long life combined with high power density, since normally the battery will not be replaced, or even accessible to a user, during the time when dispensing of the blister contents is being monitored. Compactness and light weight are also important. At the time of writing, lithium-thionyl-chloride primary cells probably offer the best combination of these properties, with greater than 10 years' storage life and typically 620 watt-hours per kilogram.

A battery made up of three series-connected lithium-thionyl-chloride cells will provide about ten volts to a load when new. It should be noted, however, that due to internal resistance the output voltage of any cell or battery will decrease with loading and also through time as the lithium or other active metal in the cells is used up. Some form of voltage stabilization (not shown) may therefore be needed for proper functioning of microcontroller 100. The BASIC Stamp, for example, has an on-board voltage regulator providing a steady +5.0 volts for the microcontroller, also available externally to power a limited number of accessory devices.

Connected directly to microcontroller 100 is an analog-to-digital converter (ADC) 110. In the preferred embodiment, ADC 120 is a Microchip Technology MCP3202. Pin numbers shown for the ADC in FIG. 8 are those for this device. It should be understood, however, that virtually any ADC having similar functions could be used. Alternatively, ADC 120 could be incorporated into microcontroller 100. Numerous microcontrollers in the PIC series, for example, have ADC functionality built in. One analog input will be required for each zone such as 70*a* or 70*b*.

In the preferred embodiment the MCP3202 has two analog inputs CH0 and CH1. Each channel, when selected, operates ratiometrically to the supply voltages, producing a 12-bit binary output ranging from zero at the negative supply voltage to 4095 at the positive supply voltage. No separate reference voltage is needed. This makes the MCP3202 ideal for reading voltage dividers: so long as all parts of the divider are driven by the same supply voltages, here applied between traces 134 and 154, the binary outputs depend only upon the ratios between supply and input voltages, and thus on the resistance ratios, and are independent of the actual supply voltages.

A further advantage of using the MCP3202 is that it can operate in this manner over a wide supply range, from 2.7 volts up to 5.5 volts. This means that since it and the voltage dividers need not be powered by the same voltage as microcontroller 100, a switching device 230 (or, optionally, a plurality of such devices) can be used under control of microcontroller 100 to energize the dividers and ADC at a very low duty cycle, thus conserving battery power. The driving voltage needs to be applied between traces 134 and 154 for only a few milliseconds, just long enough for the divider voltages to stabilize and be read, and can then be switched off until the next set of readings is needed.

In the preferred embodiment, device 230 is an NPN bipolar transistor whose base current is supplied by an I/O (input-output) pin of microcontroller 100 and limited by a resistor 232, while its collector may be supplied either from the regulated +5V power supply (as shown in the Figure) or directly from the positive terminal of battery 110. Trace 154 contains no switching device and serves as a common negative supply to all components.

With the I/O pin near +5V relative to trace 154, the base-emitter drop in switching device 230 sets the MCP3202's positive supply voltage about 4.3 volt above trace 154, near the center of its operating supply voltage range. This voltage is conveyed through connection means 180*a* to trace 34 and thence to the resistive traces in zones 170*a* and 170*b*. With the I/O pin at a voltage near trace 154's, switching device 230 is turned off and the voltage divider draws substantially no current from the battery, thus prolonging battery life.

Alternatively, switching device 230 could be a PNP bipolar transistor, an n-channel or p-channel field-effect transistor, an optical isolator or static switch, or any other device able to enter both conducting and non-conducting states as is well-known in the art of electronic switching.

Having passed through zones 170*a* and 170*b*, the current then continues through resistive traces 174*a* and 174*b* and returns along trace 154 through connection means 180*b* and ultimately to the negative terminal of battery 110. The resulting divided voltages, lying in the range between the positive and negative supply voltages on traces 134 and 154, are conveyed through traces 160*a* and 160*b* and connection means 180*c* and 180*d* to the analog inputs of ADC 120.

Since electrical noise is omnipresent today, some means for low-pass filtering, such as signal averaging is preferably employed. This may be done either in hardware, in software, or, more preferably, in both. In the preferred embodiment of the invention, hardware averaging is performed by connecting a capacitor such as 132*a* or 132*b* between each analog input to ADC 120 and ground, thus acting as a low-pass filter. Experiment has shown that when employed along with the software averaging method to be described later, a cutoff frequency between 5 KkHz and 10 kHz is sufficient. This permits the use of very modest-sized, film or ceramic capacitors thus reducing system weight, bulk and cost. With a prototype model of the preferred embodiment of the invention, an optimal capacitor value was found to be about 0.22 microfarad.

Communication between microcontroller 100 and ADC converter 120 may be serial or parallel and may use any of several standardized communication protocols well-known in the art of microcontroller and microprocessor interfacing. The MCP3202 in the preferred embodiment uses the Serial Peripheral Interface (SPI) protocol, requiring four unidirectional (half-duplex) digital lines indicated in FIG. 8 by 140, 142, 144 and 146. Chip Select line 140 must transition from logic "1" (near +5 volts) to logic "0" (near ground) to start the process. Clock line 142 coordinates data transfer, one data bit moving to (or from) the ADC on each clock cycle from "0" to "1" and then back to "0" again. For each reading, four configuration bits are sent out by microcontroller 100 on "Data In" line 144 selecting, among other things, which analog channel will be read. Data conversion by the ADC begins when the last of these bits has been read. Twelve data bits are then sent back on "Data Out" line 146, representing the binary equivalent of the analog voltage selected.

Since microcontroller 100 and ADC 120 do not share the same positive supply voltage, some provision must be made to prevent excessive current from passing through lines 140 through 146 on a logic "1." The simplest way to do this is simply to insert resistance into the lines, as shown. Data-line resistors must have values large enough to prevent excessive current but small enough not to impact the speed of data transfer. While the needed value is far from critical, a modest amount of experimentation may be desirable to find the best value for any particular application. A value of 12,000 ohms was chosen for use in the prototype, and proved satisfactory.

To further minimize the effects of noise, software data averaging is employed in addition to the hardware low-pass filtering already discussed. In the preferred embodiment, channels 0 and 1 are read alternately—each reading cycle and the associated data manipulation taking roughly 1.6 millisecond—until each has been read ten times. The results of readings for each channel are added together. The full cycle thus comprises twenty readings spaced out across about 32 milliseconds, or roughly two full cycles of the 60 Hz power frequency. Distributing the readings in time this way eliminates most components of noise at 60 Hz and its lower harmonics, thus permitting the hardware filter to have a much higher cutoff frequency with the advantages previously cited.

Start trace 166 functions as described previously, and is connected to microcontroller 100 through connection means 180*e* and 180*f* leading to pins 162 and 164 which function as described earlier. Upon first activation of the microcontroller after attachment to the blister pack, or still earlier if a temporary jumper is factory-installed between means 180*e* and 180*f*, a brief positive (logic "1") pulse is sent out by I/O pin 162 of microcontroller 100. Passing through means 180*e* and trace 166 (or through the temporary jumper, if used) current returns through means 180*f* to pin 164, pulling it high long enough to be detected by the microcontroller.

At all other times, pin 164 is held at or near ground voltage (logic "0") by resistor 148. Again while the needed value for this resistor is far from critical, a modest amount of experimentation may be desirable to find the best value for any particular application. Once more a value of 12,000 ohms was chosen for use in the prototype, and proved satisfactory.

This cycle is then repeated at short intervals until the breakage of trace 166 is detected. During this waiting period, module 130 performs no other functions and spends the great majority of its time in a low-power "sleep" state to conserve the batteries. Only when trace 66 has been broken, signaling that the blister pack has been dispensed to the user, does the more current-demanding cycle of voltage-divider powering and analog data collection and conversion begin.

At intervals, then, switching device 130 sends current to the voltage dividers, ADC 120 reads the resulting voltages, and microcontroller 100 manipulates the digitized voltages to determine the number of blisters whose traces remain unbroken. Breakage detection is based upon the passage of the digitized voltage through a pre-established threshold, representing the midpoint between the voltage currently being read and that predicted to be read if one more trace is broken. To minimize possible error due to variations in resistance among the traces in a zone, the calculation of each threshold is based upon actual voltages read from each array, both at the time of dispensing and at the last detection of breakage, in an adaptive algorithm as was previously explained.

During reduction of the invention to practice, this approach was found to prevent virtually all false-positive or false-negative detections of broken traces. A few exceptions were seen in a "worst-case" test prototype in which all traces were replaced by precision resistors either 10% above or 10% below their average value, connected to module 30 through switches to simulate breakage yet permit reuse. Opening six or more switches (representing blisters) in the same zone with systematic variation—that is, either with all resistors connected to the opened switches having values 10% above nominal, or with all having values 10% below nominal—during a single timing cycle sometimes caused a miscount of plus or minus one since the combined error then exceeded 50% of the average resistance.

In a real blister pack, however, with resistors formed adjacent to one another and showing a near-Gaussian spread of values as they did on the test card, systematic variation like this should not occur and reliable counting could be expected. Even should such a miscount occur, the simple fact that so large a number of blisters had been opened in so short a time would be evidence of gross abuse, unauthorized sharing or possible sale of the medication.

Errors were also seen to result from the limitation of the BASIC Stamp to 16-bit integer mathematics.

An exact solution of the equation previously given for the number of traces remaining unbroken, $$n_x = Q/[(V_0/V_x)(Q/N_0+1)-1],$$

requires the division of $V_0$ by $V_x$, of Q by $N_0$, then of Q by the result of further computation. Unfortunately, division in integer math is a low-resolution process: when a variable having m bits (after leading zeros are removed) is divided by one having n bits, the result can have, at most, (m−n)+1 bits. For example, dividing 255 ($11111111_2$; m=8) by 16 ($10000_2$; n=5) yields 15.93, which is normally truncated to just 15 ($1111_2$; (m−n)+1=4). Thus the more accurately the divisor is known, the less accurate will be the quotient.

A work-around was devised for use with the Stamp, using an ad-hoc linear approximation to the measured slope of $n_x$ as a function of $V_x$ using the switched-resistor prototype, and proved sufficiently accurate to permit reduction to practice and demonstration of the working prototype. Unfortunately, to use this approach in a practical system would require finding a new approximation each time Q or $N_0$ changed.

A preferable approach, therefore, would be to use a microcontroller and programming language which allow either floating-point division and/or integer variables larger than 16 bits. Either approach would solve this problem, making the linear approximation unnecessary.

FIG. 9 shows the operation of the preferred embodiment of the invention in the form of a flow chart. Ovals represent start and end points and connectors; rectangles, operations internal to the blister pack and electronics module; parallelograms, input and output operations to or from a host computer; diamonds, decision blocks including the tests upon which the decisions are made; and arrows, sequential progression through the program. Heavy block outlines show a function is performed by a host computer; lighter ones, by module 130. No other symbols are used.

While FIG. 9 shows operations conducted in specific sequences, in many cases these steps could be conducted in a different order or combined in various ways to perform the same functions, as is well known in the art of computer and microcontroller programming. Similarly, the program is shown as monitoring exactly two zones of blisters on a pack. In practice, the number of zones and the size of each would be matched to the needs of the patient, with multiple zones configurable at the factory or through keyboard selection of zone number and size from the host computer by a pharmacist before dispensing.

"EEPROM" as used in FIG. 9 denotes any form of rewritable nonvolatile memory, including classical EEPROM (electrically erasable programmable read-only memory), flash memory, battery-backed random-access memory (RAM), phase-change memory, and other technologies of like function. Similarly, "USB" as here used denotes any connection to a host computer used to monitor the microcontroller's operation or read data back from nonvolatile memory to the host. "Print" may indicate the creation of a hard copy, an electronic file entry, or both, by a host computer.

The interval shown as "30 seconds" at the bottom of the main loop could alternatively be made of any other practical length. 30 seconds was chosen simply as a convenient balance between adequate resolution in time and long battery life, since the principal drain on the battery occurs when the microcontroller comes out of "sleep" mode and the voltage dividers are energized for reading.

At start, all variables are initialized and a USB connection is identified and initialized if present. The "start" trace is then tested once, and if it is already broken module 30 assumes the blister pack is being returned to the manufacturer or to a participating pharmacy for reading back of stored data. If not, module 130 continues testing the "start" trace at short intervals, spending the time between tests in low-power "sleep" mode.

When the "start" trace is cut to indicate the blister pack has been dispensed, the program initializes the timing counter, records an initial set of voltage readings representing traces intact for all zones, and calculates a first set of voltage thresholds for trace breakage detection. The program then enters its main loop.

In the main loop, module 130 first takes and records the voltages from all zones. All are preferably read during the same interval and in repeated rotation, so the conversion time for each channel inserts a delay between successive readings of the others permitting simple summing or averaging to remove low-frequency noise as was previously explained.

For each zone in succession, the read (summed or averaged) binary equivalent of voltage is compared with the calculated threshold, and if beyond that threshold, one or more traces are presumed broken since the last reading. The remaining number of traces and the next threshold are then calculated, and the new trace number and the time of reading are recorded in nonvolatile memory. If the read voltage has not changed past the threshold, no traces are presumed broken since the last reading, and no data recording is made.

In the preferred embodiment, each recording takes a fixed number of bytes so only a simple pointer variable, incremented by that same number each time a recording is made or read, is needed to keep track of memory organization during recording or readback. For example, in the reduction to practice each recording comprised four bytes: the first holding a zone identifier (zero for one zone, 100 for the other) plus the new number of traces remaining in the zone, and the second, third and fourth of the four bytes of the 24-bit value held in the timing counter, representing the number of timing cycles executed since the "start" trace was cut.

Obviously, many alternative schemes could be used to organize the same data.

In a more elaborate implementation, a real-time clock/calendar (RTCC) integrated circuit such as the Microchip Technology MCP7940M could be incorporated into module 130, replacing the cycle counter implemented in software. Advantages of using an RTCC is that each trace break, including the "start" trace, indicating the package had been dispensed, would be tagged in memory with the actual date and time when it occurred and that no reference would need to be made to any written notation on the card itself. Disadvantages are the need for the RTCC to be initialized as an extra step in manufacturing module 130, the extra cost of the RTCC and associated clock crystal, and the added space (six bytes, or seven if the day of the week is included, rather than three for the cycle counter) needed in nonvolatile memory to store the information regarding when the trace break event occurred.

Once all zones have been read, new thresholds are calculated and data are recorded, if necessary, module 130 checks the number of traces remaining in all zones. If traces remain in any zone, apart from the security ones (if used), the timing counter is incremented by one and the microcontroller then enters a low-power "sleep" mode for a predetermined time, here shown as 30 seconds. At the end of that time, the cycle is repeated.

If no non-security traces remain in any zone, the microcontroller marks the end of the file by writing one or more bytes to nonvolatile memory. These byte(s) can hold any specific combination of bits which would not occur in a normal data recording. For example, a binary 10101010 (decimal 170) can be used since it represents an impossible situation, namely, 70 traces remaining in the second zone. With an RTCC, as another example, a "minutes" value greater than 59 or "hours" value greater than 24 might be used. Having written the end-of-file characters to memory, the microcontroller enters "sleep" mode.

Upon return of the used blister package to the manufacturer or a participating pharmacy, the program is restarted through connection to a host computer and initializes as described previously. On detecting the "start" trace already broken, however, the program branches to "Readback."

Patient-specific information written or recorded on the card, including the names of the patient, prescribing physician and medication, and the date and time dispensed if module 130 includes no RTCC, is requested from the operator and accepted through a keyboard or electronic means such as a magnetic stripe, a one- or two-dimensional barcode, or directly from memory in module 130. The information may then be printed out as a hard copy, made part of an electronic file in the host computer, or both.

Trace breakage information is then retrieved from nonvolatile memory in module 130, one recorded block at a time. In the reduction to practice, for example, each block held four bytes as previously explained. Module 130 checks for the end-of-file characters, and if they are not found, passes the data to the host computer which performs any needed calculation and then prints the information and/or adds it to the electronic file as was done with the patient-specific information. When the end-of-file characters appear, module 130 signals "End of data" to the host computer and operator, then shuts down.

As is evident from the above description, the present invention may be embodied in other specific forms than the embodiments described above without departing from the spirit or essential attributes of the invention. Accordingly, reference should be made to the appended claims, rather than the foregoing specification, as indicating the scope of the invention.

What is claimed is:

1. A blister pack for dispensing medication and the like, comprising:

(a) a blister card having plural blisters, said blister card including a sheet of plastic having said plural blisters formed therein and a backing applied to said sheet of plastic, said backing enclosing each blister of said blisters;

(b) an electronics module carried by said blister card, said electronics module including a microcontroller for receiving and generating data and a memory for storing said data;

(c) plural breakable resistive traces, one breakable resistive trace of said plural breakable resistive traces being applied to said backing behind each blister of said plural blisters, each breakable resistance trace of said plural breakable resistance traces being spatially extended;

(d) a reference resistance trace applied to said backing;

(e) conductive traces applied to said backing to connect in parallel said each breakable resistance trace with each other breakable resistance trace of said plural breakable resistance traces, to connect in series said reference resistance trace with said plural breakable resistance traces, and to connect in series said electronics module with said reference resistance trace and with said plural breakable resistance traces; and (f) a power source for providing electrical power to said electronics module, said microcontroller of said electronics module using said electric power to apply a voltage across said reference resistance trace and said plural breakable resistance traces to detect breakage of said each breakable resistance trace, wherein said microcontroller is configured to detect breakage of said each breakable resistance trace from changes measured in resistance of said plural breakable resistance traces and from changes measured in the ratio of resistance of said plural breakable resistance traces with respect to resistance of said reference resistance trace.

2. The blister pack as recited in claim 1, wherein said microcontroller is configured to detect said changes in said resistance of said plural breakable resistance traces based on measured voltage across unbroken breakable resistance traces of said plural breakable resistance traces.

3. The blister pack as recited in claim 2, wherein said microcontroller is programmed to calculate a voltage threshold based on said measured voltage, the number of said unbroken breakable resistance traces and said ratio of resistance of said plural breakable resistance traces with respect to said resistance of said reference resistance trace.

4. The blister pack as recited in claim 3, wherein said microcontroller is programmed to calculate said voltage threshold mid-way between a voltage across said unbroken breakable resistance traces and a voltage across one breakable resistance trace less than said unbroken breakable resistance traces.

5. The blister pack as recited in claim 2, wherein said measured voltage is recorded in said memory.

6. The blister pack as recited in claim 1, wherein said each breakable resistance trace is principally oriented in the same direction as each other breakable resistance trace of said plural breakable resistance traces.

7. The blister pack as recited in claim 1, wherein said memory is non-volatile memory and said power source is a battery, and wherein said microcontroller is programmed to have a sleep mode and to cycle on and off said sleep mode, detecting breakage of said each breakable resistance trace when cycled on and being in sleep mode when cycled off.

8. The blister pack as recited in claim 7, wherein when said microcontroller cycles on, said microcontroller makes plural measurements of changes in voltage across said plural breakable resistance traces during each cycle, averaging said plural measurements of voltage to avoid electric noise artifacts.

9. The blister pack as recited in claim 7, wherein said microprocessor increments a count of said cycles and stores said count of said cycles in memory in associated with a detection of breakage of each breakable resistance trace.

10. The blister pack as recited in claim 1, further comprising a start resistance trace in electrical series with said reference resistance trace, wherein breach of said start resistance trace activates said electronic module.

11. The blister pack as recited in claim 10, wherein time associated with detection of breaking said each breakable resistance trace is accumulated upon breaking said start resistance trace.

12. The blister pack as recited in claim 1, further comprising a tampering resistance trace in electrical connection with said electronics module, wherein breach of said tampering resistance trace causes said microcontroller to generate an alarm message.

13. The blister pack as recited in claim 12, wherein said blister card has a rim and wherein said tampering resistance trace runs around said rim of said blister card.

14. The blister pack as recited in claim 12, wherein said microprocessor enters said alarm message in said memory.

15. The blister pack as recited in claim 12 wherein said tampering resistance trace is connected electrically in parallel with said plural breakable resistance traces.

16. The blister pack as recited in claim 13, wherein said tampering resistance trace has a resistance greater than said resistance of said each breakable resistance trace.

17. The blister pack as recited in claim 1, wherein said plural breakable resistance traces and said reference resistance trace are made of an electrically resistive material and said conductive traces are made of an electrically conductive material wherein the electrical resistance of said resistive material is at least an order of magnitude higher than the resistance of said conductive material.

18. The blister pack as recited in claim 1, wherein said plural breakable resistance traces are made of a resistive material having a first thickness and said conductive traces are made of said resistive material in a second thickness greater than said first thickness so that the resistance of said conductive material is lower than said resistance of said plural resistive traces.

19. The blister pack as recited in claim 1, wherein said plural breakable resistance traces are made of a first material and said conductive traces are made of a second material, said second material being made of both low and high resistance materials so that the effective resistance of said second material is lower than said resistance of said first material by at least an order of magnitude.

20. The blister pack as recited in claim 1, wherein said conductive traces are made of a layer of conductive foil stamped onto said backing and a layer of said resistive material.

21. A blister pack for dispensing medication, comprising:

(a) a blister card having plural blisters, said blister card including a sheet of plastic having said plural blisters formed therein and a backing applied to said sheet of plastic, said backing enclosing each blister of said blisters;

(b) an electronics module carried by said blister card, said electronics module including a microcontroller for receiving and generating data and a memory for storing said data;

(c) plural breakable resistive traces, one breakable resistive trace of said plural breakable resistive traces being applied to said backing behind said each blister of said plural blisters, each breakable resistance trace of said plural breakable resistance traces being spatially extended;

(d) a reference resistance trace applied to said backing;

(e) conductive traces applied to said backing to connect in parallel said each breakable resistance trace with each other breakable resistance trace of said plural breakable resistance traces, to connect in series said reference resistance trace with said plural breakable resistance traces, and to connect in series said electronics module with said reference resistance trace and with said plural breakable resistance traces; and (f) a power source for providing electrical power to said electronics module, said microcontroller of said electronics module using said electric power to apply a voltage across said reference resistance trace and said plural breakable resistance traces to detect breakage of said each breakable resistance trace, wherein said each breakable resistance trace is principally oriented in the same direction as each other breakable resistance trace of said plural breakable resistance traces.

22. A blister pack for dispensing medication, comprising:

(a) a blister card having plural blisters, said blister card including a sheet of plastic having said plural blisters formed therein and a backing applied to said sheet of plastic, said backing enclosing each blister of said blisters;

(b) an electronics module carried by said blister card, said electronics module including a microcontroller for receiving and generating data and a memory for storing said data;

(c) plural breakable resistive traces, one breakable resistive trace of said plural breakable resistive traces being applied to said backing behind said each blister of said plural blisters, each breakable resistance trace of said plural breakable resistance traces being spatially extended;

(d) a reference resistance trace applied to said backing;

(e) conductive traces applied to said backing to connect in parallel said each breakable resistance trace with each other breakable resistance trace of said plural breakable resistance traces, to connect in series said reference resistance trace with said plural breakable resistance traces, and to connect in series said electronics module with said reference resistance trace and with said plural breakable resistance traces; and (f) a power source for providing electrical power to said electronics module, said microcontroller of said electronics module using said electric power to apply a voltage across said reference resistance trace and said plural breakable resistance traces to detect breakage of said each breakable resistance trace, wherein said memory is non-volatile memory and said power source is a battery, and wherein said microcontroller is programmed to have a sleep mode and to cycle on and off said sleep mode, detecting breakage of said each breakable resistance trace when cycled on and being in sleep mode when cycled off.

23. The blister pack as recited in claim 22, wherein when said microcontroller cycles on, said microcontroller makes plural measurements of changes in voltage across said plural breakable resistance traces during each cycle, averaging said plural measurements of voltage to avoid electric noise artifacts.

24. The blister pack as recited in claim 22, wherein said microprocessor increments a count of said cycles and stores said count of said cycles in memory in associated with a detection of breakage of each breakable resistance trace.

25. A blister pack for dispensing medication, comprising:

(a) a blister card having plural blisters, said blister card including a sheet of plastic having said plural blisters formed therein and a backing applied to said sheet of plastic, said backing enclosing each blister of said blisters;

(b) an electronics module carried by said blister card, said electronics module including a microcontroller for receiving and generating data and a memory for storing said data;

(c) plural breakable resistive traces, one breakable resistive trace of said plural breakable resistive traces being applied to said backing behind said each blister of said plural blisters, each breakable resistance trace of said plural breakable resistance traces being spatially extended;

(d) a reference resistance trace applied to said backing;

(e) conductive traces applied to said backing to connect in parallel said each breakable resistance trace with each other breakable resistance trace of said plural breakable resistance traces, to connect in series said reference resistance trace with said plural breakable resistance traces, and to connect in series said electronics module with said reference resistance trace and with said plural breakable resistance traces;

(f) a power source for providing electrical power to said electronics module, said microcontroller of said electronics module using said electric power to apply a voltage across said reference resistance trace and said plural breakable resistance traces to detect breakage of said each breakable resistance trace; and (g) a start resistance trace in electrical series with said reference resistance trace, wherein breach of said start resistance trace activates said electronic module.

26. The blister pack of claim 25, wherein time associated with detection of breaking said each breakable resistance trace is accumulated upon breaking said start resistance trace.

27. A blister pack for dispensing medication, comprising:

(a) a blister card having plural blisters, said blister card including a sheet of plastic having said plural blisters formed therein and a backing applied to said sheet of plastic, said backing enclosing each blister of said blisters;

(b) an electronics module carried by said blister card, said electronics module including a microcontroller for receiving and generating data and a memory for storing said data;

(c) plural breakable resistive traces, one breakable resistive trace of said plural breakable resistive traces being applied to said backing behind said each blister of said plural blisters, each breakable resistance trace of said plural breakable resistance traces being spatially extended;

(d) a reference resistance trace applied to said backing;

(e) conductive traces applied to said backing to connect in parallel said each breakable resistance trace with each other breakable resistance trace of said plural breakable resistance traces, to connect in series said reference resistance trace with said plural breakable resistance traces, and to connect in series said electronics module with said reference resistance trace and with said plural breakable resistance traces;

(f) a power source for providing electrical power to said electronics module, said microcontroller of said electronics module using said electric power to apply a voltage across said reference resistance trace and said plural breakable resistance traces to detect breakage of said each breakable resistance trace; and (g) a tampering resistance trace in electrical connection with said electronics module, wherein breach of said tampering resistance trace causes said microcontroller to generate an alarm message.

28. The blister pack as recited in claim 27, wherein said blister card has a rim and wherein said tampering resistance trace runs around said rim of said blister card.

29. The blister pack as recited in claim 27, wherein said microprocessor enters said alarm message in said memory.

30. The blister pack as recited in claim 27 wherein said tampering resistance trace is connected electrically in parallel with said plural breakable resistance traces.

31. The blister pack as recited in claim 28, wherein said tampering resistance trace has a resistance greater than said resistance of said each breakable resistance trace.

32. A blister pack for dispensing medication, comprising:

(a) a blister card having plural blisters, said blister card including a sheet of plastic having said plural blisters formed therein and a backing applied to said sheet of plastic, said backing enclosing each blister of said blisters;

(b) an electronics module carried by said blister card, said electronics module including a microcontroller for receiving and generating data and a memory for storing said data;

(c) plural breakable resistive traces, one breakable resistive trace of said plural breakable resistive traces being applied to said backing behind said each blister of said plural blisters, each breakable resistance trace of said plural breakable resistance traces being spatially extended;

(d) a reference resistance trace applied to said backing;

(e) conductive traces applied to said backing to connect in parallel said each breakable resistance trace with each other breakable resistance trace of said plural breakable resistance traces, to connect in series said reference resistance trace with said plural breakable resistance traces, and to connect in series said electronics module with said reference resistance trace and with said plural breakable resistance traces; and (f) a power source for providing electrical power to said electronics module, said microcontroller of said electronics module using said electric power to apply a voltage across said reference resistance trace and said plural breakable resistance traces to detect breakage of said each breakable resistance trace, wherein said plural breakable resistance traces and said reference resistance trace are made of an electrically resistive material and said conductive traces are made of an electrically conductive material wherein the electrical resistance of said resistive material is at least an order of magnitude higher than the resistance of said conductive material.

33. A blister pack for dispensing medication, comprising:

(a) a blister card having plural blisters, said blister card including a sheet of plastic having said plural blisters formed therein and a backing applied to said sheet of plastic, said backing enclosing each blister of said blisters;

(b) an electronics module carried by said blister card, said electronics module including a microcontroller for receiving and generating data and a memory for storing said data;

(c) plural breakable resistive traces, one breakable resistive trace of said plural breakable resistive traces being applied to said backing behind said each blister of said plural blisters, each breakable resistance trace of said plural breakable resistance traces being spatially extended;

(d) a reference resistance trace applied to said backing;

(e) conductive traces applied to said backing to connect in parallel said each breakable resistance trace with each other breakable resistance trace of said plural breakable resistance traces, to connect in series said reference resistance trace with said plural breakable resistance traces, and to connect in series said electronics module with said reference resistance trace and with said plural breakable resistance traces; and (f) a power source for providing electrical power to said electronics module, said microcontroller of said electronics module using said electric power to apply a voltage across said reference resistance trace and said plural breakable resistance traces to detect breakage of said each breakable resistance trace, wherein said plural breakable resistance traces are made of a resistive material having a first thickness and said conductive traces are made of said resistive material in a second thickness greater than said first thickness so that the resistance of said conductive material is lower than said resistance of said plural resistive traces.

34. A blister pack for dispensing medication, comprising:

(a) a blister card having plural blisters, said blister card including a sheet of plastic having said plural blisters formed therein and a backing applied to said sheet of plastic, said backing enclosing each blister of said blisters;

(b) an electronics module carried by said blister card, said electronics module including a microcontroller for receiving and generating data and a memory for storing said data;

(c) plural breakable resistive traces, one breakable resistive trace of said plural breakable resistive traces being applied to said backing behind said each blister of said plural blisters, each breakable resistance trace of said plural breakable resistance traces being spatially extended;

(d) a reference resistance trace applied to said backing;

(e) conductive traces applied to said backing to connect in parallel said each breakable resistance trace with each other breakable resistance trace of said plural breakable resistance traces, to connect in series said reference resistance trace with said plural breakable resistance traces, and to connect in series said electronics module with said reference resistance trace and with said plural breakable resistance traces; and (f) a power source for providing electrical power to said electronics module, said microcontroller of said electronics module using said electric power to apply a voltage across said reference resistance trace and said plural breakable resistance traces to detect breakage of said each breakable resistance trace, wherein said conductive traces are made of a layer of conductive foil stamped onto said backing and a layer of said resistive material.

* * * * *